US011329385B2

(12) United States Patent
Harel et al.

(10) Patent No.: US 11,329,385 B2
(45) Date of Patent: May 10, 2022

(54) TRIPOD RADIATING ELEMENT

(71) Applicant: Nokia Shanghai Bell Co., Ltd., Shanghai (CN)

(72) Inventors: Jean-Pierre Harel, Lannion (FR); Jerome Plet, Louannec (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 16/987,587

(22) Filed: Aug. 7, 2020

(65) Prior Publication Data

US 2022/0045429 A1 Feb. 10, 2022

(51) Int. Cl.
*H01Q 9/06* (2006.01)
*H01Q 5/45* (2015.01)
(Continued)

(52) U.S. Cl.
CPC ..... *H01Q 9/065* (2013.01); *H01Q 1/523* (2013.01); *H01Q 5/48* (2015.01); *H01Q 21/24* (2013.01)

(58) Field of Classification Search
CPC ..... H01Q 9/065; H01Q 5/48; H01Q 21/24; H01Q 1/523; H01Q 21/062; H01Q 21/067; H01Q 21/068
See application file for complete search history.

(56) References Cited

U.S. PATENT DOCUMENTS 7,209,091 B2 * 4/2007 Schadler ..... H01Q 21/062 343/812
8,957,824 B2 * 2/2015 Choi ..... H01Q 21/26 343/795

(Continued)

FOREIGN PATENT DOCUMENTS

DE 202005015708 U1 12/2005
DE 202016102196 U1 6/2016
EP 33017756 A1 4/2018

OTHER PUBLICATIONS

"Balun"; Wikipedia; Downloaded from the Internet on Jul. 13, 2020, https://en.wikipedia.org/wiki/Balun; whole document (6 pages).

*Primary Examiner* — Vibol Tan
(74) *Attorney, Agent, or Firm* — Harrington & Smith

(57) ABSTRACT

In a first aspect of the present disclosure, an antenna includes: a ground plane; a central support extending from the ground plane, the central support having two feeding probes, each of the feeding probes having a first part and a second part, each of the first part and the second part being separated from one another and from the first and second parts of the other feeding probe; and four radiating arms, one radiating arm extending from each of the first and second parts of each feeding probe, wherein at least a portion of at least two of the radiating arms extends in directions different from orientations of their respective parts of the feeding probes. In a second aspect, an antenna array includes: a plurality of antennas disposed in an array on a common ground plane, wherein each of the antennas comprises: a central support extending from the common ground plane, the central support having two feeding probes, each of the feeding probes having a first part and a second part, each of the first part and the second part being separated from one another and from the first and second parts of the other feeding probe; and four radiating arms, one radiating arm extending from each of the first and second parts of each feeding probe, wherein at least a portion of at least two of the radiating arms extends in directions different from orientations of their respective parts of the feeding probes.

22 Claims, 20 Drawing Sheets

(51) Int. Cl.

| | |
|---|---|
| ***H01Q 1/52*** | (2006.01) |
| ***H01Q 21/24*** | (2006.01) |
| ***H01Q 5/48*** | (2015.01) |

(56) References Cited

U.S. PATENT DOCUMENTS

| | | | | |
|---|---|---|---|---|
| 9,276,323 | B2 * | 3/2016 | Moon | H01Q 5/48 |
| 10,389,018 | B2 * | 8/2019 | Daojian | H01Q 21/26 |
| 10,530,068 | B2 * | 1/2020 | Mirmozafari | H01Q 5/48 |
| 10,854,959 | B2 * | 12/2020 | Jang | H01Q 5/42 |
| 11,024,980 | B2 * | 6/2021 | Vollmer | H01Q 1/246 |
| 2012/0280879 | A1 | 11/2012 | Zimmerman et al. | |
| 2018/0191075 | A1 | 7/2018 | Semenov | |
| 2019/0140364 | A1 * | 5/2019 | Mirmozafari | H01Q 21/24 |

* cited by examiner

TRIPOD RADIATING ELEMENT

TECHNICAL FIELD

This disclosure relates to antenna architectures requiring "tripod" dual-polarized radiating elements, which enable conventional +45° and −45° slanted E-electromagnetic field polarizations to be achieved, despite the elements themselves being oriented vertically and horizontally.

BACKGROUND

In antenna architectures of this type, the "tripod" radiating elements either share a central element or two central elements are used. In case of the latter, the two central elements are placed near one another, leading to poor port-to-port isolation. Moreover, the related balun arrangement, that is, current balance, is quite weak in these standard designs.

There is a need to improve the RF (radio frequency) performances of such antenna designs, particularly, the isolation between ports.

"Tripod" dual-polarized radiating element arrangements are used for particular antenna arrays, in which, for example, there is no room to place conventional +45° and −45° slanted elements, or in which some decoupling performance is needed against other radiating elements from the same frequency band or from different frequency bands.

Usually, the +45° and −45° slanted polarizations are linked to the physical orientation of the radiating elements, such as a simple double dipole, two dipoles crossing one another at a 90° angle.

It is possible to achieve such +45° and −45° slanted polarizations while the dipole topology itself is not mechanically slanted, meaning that the dipole topology does not have elements placed vertically and horizontally, by having each of the two +45° and −45° signal feed one vertical and one horizontal branch of the radiating element arrangement. Then, the slanted +45° and −45° E-electromagnetic fields are reformed by the summation of one 0° and 90° E-electromagnetic fields, and the other 0° and −90° E-electromagnetic fields.

As previously noted, the "tripod" radiating elements either share a central element or two central elements are used. As a consequence, the central element can either be shared by the two slanted polarizations, or the two slanted polarizations may be split between two central elements. Nevertheless, when split, the two central elements are kept near each other to achieve an almost identical center of phase for the reformed slanted +45° and −45° E-electromagnetic fields.

SUMMARY

In a first exemplary embodiment of the present disclosure, an antenna comprises: a ground plane; a central support extending from the ground plane, the central support having two feeding probes, each of the feeding probes having a first part and a second part, each of the first part and the second part being separated from one another and from the first and second parts of the other feeding probe; and four radiating arms, one radiating arm extending from each of the first and second parts of each feeding probe, wherein at least a portion of at least two of the radiating arms extends in directions different from orientations of their respective parts of the feeding probes.

The central support may extend perpendicularly from the ground plane. The four radiating arms may extend perpendicularly from their respective feeding probes and parallel to the ground plane.

The first and second parts of one of the feeding probes may be aligned with one another in a first direction, and the first and second parts of the other of the feeding probes may be aligned with one another in a second direction different from said first direction. The first direction may be perpendicular to the second direction.

The first and second parts of one of the feeding probes may not be aligned with respect to one another, and the first and second parts of the other feeding probe may not be aligned with respect to one another.

At least a portion of two of the radiating arms may extend from their respective parts of the feeding probes parallel to one another, and at least a portion of the remaining two of the radiating arms may extend from their respective parts of the feeding probes in opposite directions perpendicular to that of the two of the radiating arms extending parallel to one another.

At least a portion of two of the radiating arms may extend from their respective parts of the feeding probes in opposite directions.

At least a portion of two of the radiating arms may extend from their respective parts of the feeding probes parallel to one another, and at least a portion of the remaining two of the radiating arms may extend from their respective parts of the feeding probes parallel to one another. At least a portion of the remaining two of the radiating arms may extend from their respective parts of the feeding probes in a direction opposite to that of the at least a portion of two of the radiating arms.

At least a portion of two of the radiating arms may extend from their respective parts of the feeding probes parallel to one another, and at least a portion of the remaining two of the radiating arms may extend perpendicularly from their respective parts of the feeding probes.

In a second exemplary embodiment of the present disclosure, an antenna array comprises: a plurality of antennas disposed in an array on a common ground plane, wherein each of the antennas comprises: a central support extending from the common ground plane, the central support having two feeding probes, each of the feeding probes having a first part and a second part, each of the first part and the second part being separated from one another and from the first and second parts of the other feeding probe; and four radiating arms, one radiating arm extending from each of the first and second parts of each feeding probe, wherein at least a portion of at least two of the radiating arms extends in directions different from orientations of their respective parts of the feeding probes.

In at least one of the antennas, at least a portion of two of the radiating arms may extend from their respective parts of the feeding probes in opposite directions. The plurality of antennas in the array may be disposed on the common ground plane around a common center, and the at least a portion of two of the radiating arms extending from their respective parts of the feeding probes in opposite directions may be disposed outermost from said common center.

In at least one of the antennas, at least a portion of two of the radiating arms may extend from their respective parts of the feeding probes parallel to one another, and at least a portion of the remaining two of the radiating arms may extend from their respective parts of the feeding probes in opposite directions perpendicular to that of the two of the radiating arms extending parallel to one another. The plurality of antennas in the array may be disposed on the common ground plane around a common center, and the at least a portion of two of the radiating arms extending from their respective parts of said feeding probes parallel to one another may be disposed innermost toward said common center.

In at least one of the antennas, at least a portion of two of the radiating arms may extend from their respective parts of the feeding probes parallel to one another, and at least a portion of the remaining two of the radiating arms may extend from their respective parts of said feeding probes parallel to one another, and the at least a portion of the remaining two of the radiating arms may extend from their respective parts of the feeding probes in a direction opposite to that of the at least a portion of two of the radiating arms. The plurality of antennas in the array may be disposed on the common ground plane around a common center, and the at least a portion of two of the radiating arms extending from their respective parts of said feeding probes parallel to one another, and the at least a portion of the remaining two of the radiating arms extending from their respective parts of the feeding probes parallel to one another, may be oriented in a direction perpendicular to a line from the central support to the common center.

In at least one of the antennas, at least a portion of two of the radiating arms may extend from their respective parts of the feeding probes parallel to one another, and at least a portion of the remaining two of the radiating arms may extend perpendicularly from their respective parts of the feeding probes. The plurality of antennas in the array may be disposed on the common ground plane around a common center, and the at least a portion of two of the radiating arms extending from their respective parts of said feeding probes parallel to one another may be disposed outermost from said common center. Alternatively, the plurality of antennas in the array may be disposed on the common ground plane around a common center, and the at least a portion of two of the radiating arms extending from their respective parts of said feeding probes parallel to one another may be disposed innermost toward said common center.

In at least one of the antennas, the first and second parts of one of the feeding probes may not be aligned with respect to one another, and the first and second parts of the other feeding probe may not be aligned with respect to one another. At least a portion of two of the radiating arms may extend from their respective parts of the feeding probes parallel to one another, and at least a portion of the remaining two of the radiating arms may extend from their respective parts of the feeding probes in opposite directions perpendicular to that of the two of the radiating elements extending parallel to one another. The plurality of antennas in the array may be disposed on the common ground plane around a common center, and the at least a portion of two of the radiating arms extending from their respective parts of the feeding probes parallel to one another may be disposed innermost toward said common center.

BRIEF DESCRIPTION OF THE DRAWINGS

The foregoing and other aspects of these teachings are made more evident in the following detailed description, when read in conjunction with the attached drawing figures.

DETAILED DESCRIPTION

Figure 1:
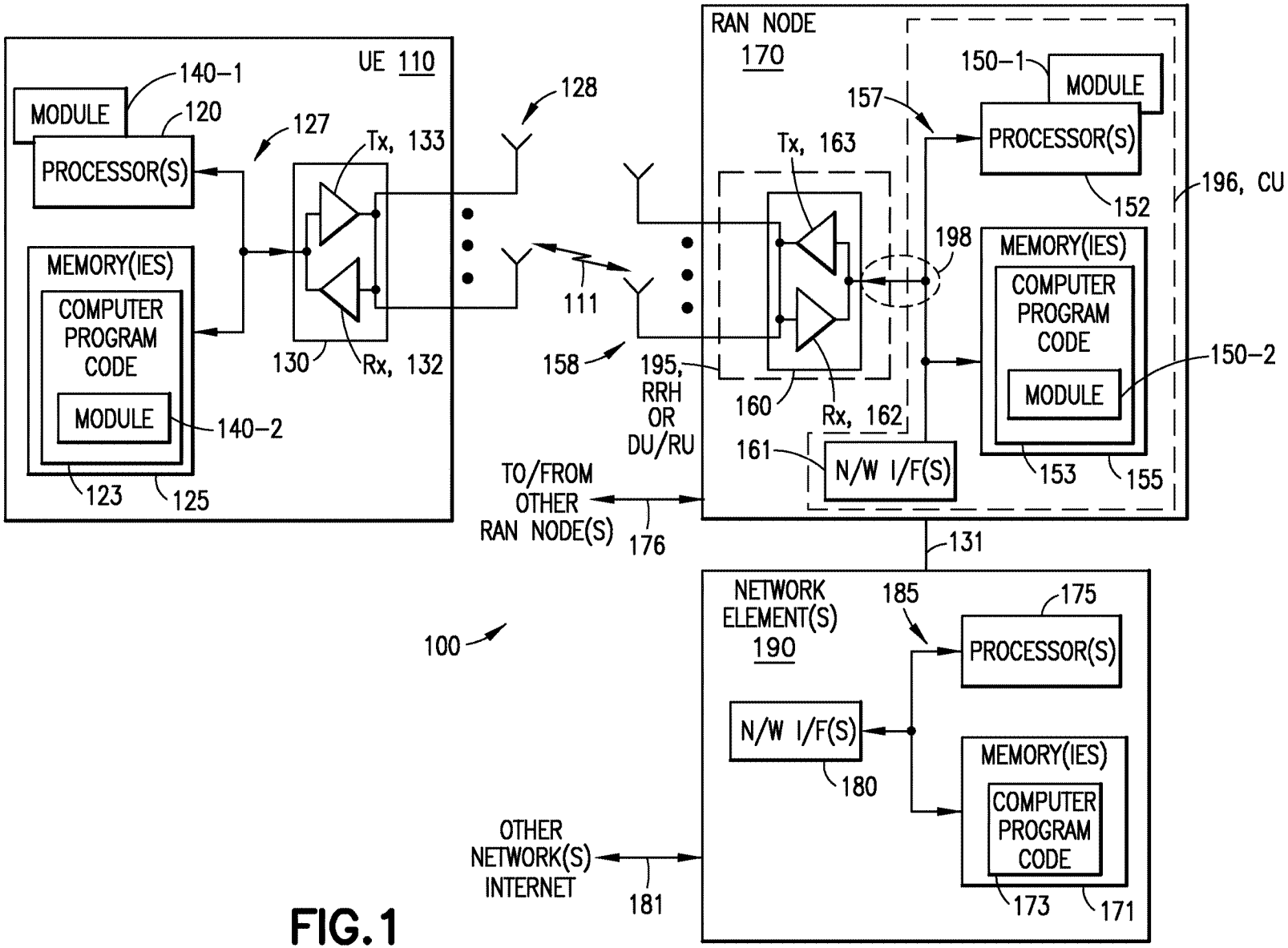
FIG. 1 shows a simplified block diagram of certain apparatus in which the subject matter of the present disclosure may be practiced.

FIG. 1 is a block diagram of one possible and non-limiting example in which the subject matter of the present disclosure may be practiced. A user equipment (UE) 110, radio access network (RAN) node 170, and network element(s) 190 are illustrated. In the example of FIG. 1, the user equipment (UE) 110 is in wireless communication with a wireless network 100. A UE is a wireless device, such as a mobile device, that can access the wireless network. The UE 110 includes one or more processors 120, one or more memories 125, and one or more transceivers 130 interconnected through one or more buses 127. Each of the one or more transceivers 130 includes a receiver, Rx, 132 and a transmitter, Tx, 133. The one or more buses 127 may be address, data, or control buses, and may include any interconnection mechanism, such as a series of lines on a motherboard or integrated circuit, fiber optics or other optical communication equipment, and the like. The one or more transceivers 130 are connected to one or more antennas 128. The one or more memories 125 include computer program code 123. The UE 110 includes a module 140, comprising one of or both parts 140-1 and/or 140-2, which may be implemented in a number of ways. The module 140 may be implemented in hardware as module 140-1, such as being implemented as part of the one or more processors 120. The module 140-1 may be implemented also as an integrated circuit or through other hardware such as a programmable gate array. In another example, the module 140 may be implemented as module 140-2, which is implemented as computer program code 123 and is executed by the one or more processors 120. For instance, the one or more memories 125 and the computer program code 123 may be configured, with the one or more processors 120, to cause the user equipment 110 to perform one or more of the operations as described herein. The UE 110 communicates with RAN node 170 via a wireless link 111.

The RAN node 170 in this example is a base station that provides access to wireless devices, such as the UE 110. The RAN node 170 may be, for example, a base station for 5G, also called New Radio (NR). In 5G, the RAN node 170 may be an NG-RAN node, which is defined as either a gNB or an ng-eNB. A gNB is a node providing NR user plane and control-plane protocol terminations toward the UE, and connected via the NG interface to a 5GC, such as, for example, the network element(s) 190. The ng-eNB is a node providing E-UTRA user plane and control plane protocol terminations towards the UE, and connected via the NG interface to the 5GC. In one of several approaches, the NG-RAN node may include multiple network elements, which may also include a centralized unit (CU) (gNB-CU) 196 and distributed unit(s) (DUs) (gNB-DUs), of which DU 195 is shown. Note that the DU may include or be coupled to and control a radio unit (RU). The gNB-CU is a logical node hosting RRC, SDAP and PDCP protocols of the gNB or RRC and PDCP protocols of the en-gNB that controls the operation of one or more gNB-DUs. The gNB-CU terminates the F1 interface connected with the gNB-DU. The F1 interface is illustrated as reference 198, although reference 198 also illustrates a link between remote elements of the RAN node 170 and centralized elements of the RAN node 170, such as between the gNB-CU 196 and the gNB-DU 195. The gNB-DU is a logical node hosting RLC, MAC and PHY layers of the gNB or ng-eNB, and its operation is partly controlled by gNB-CU. One gNB-CU supports one or multiple cells. One cell is supported by only one gNB-DU. The gNB-DU terminates the F1 interface 198 connected with the gNB-CU. Note that the DU 195 is considered to include the transceiver 160, for example, as part of a RU, but some examples of this may have the transceiver 160 as part of a separate RU, for example, under control of and connected to the DU 195. The RAN node 170 may also be an eNB (evolved NodeB) base station, for LTE (long term evolution), or any other suitable base station or node. The preceding paragraph describes one way of splitting the gNB functions:

other splits are possible as well with different distributions of [LOW-PHY/HIGH-PHY/PHY]MAC/RLC/PDCP[/SDAP]/RRC functions across the various network nodes and different interfaces for connecting the network nodes.

The RAN node 170 includes one or more processors 152, one or more memories 155, one or more network interfaces (N/W I/F(s)) 161, and one or more transceivers 160 interconnected through one or more buses 157. Each of the one or more transceivers 160 includes a receiver, Rx, 162 and a transmitter, Tx, 163. The one or more transceivers 160 are connected to one or more antennas 158. The one or more memories 155 include computer program code 153. The CU 196 may include the processor(s) 152, memories 155, and network interfaces 161. Note that the DU 195 may also contain its own memory/memories and processor(s), and/or other hardware, but these are not shown.

The RAN node 170 includes a module 150, comprising one of or both parts 150-1 and/or 150-2, which may be implemented in a number of ways. The module 150 may be implemented in hardware as module 150-1, such as being implemented as part of the one or more processors 152. The module 150-1 may be implemented also as an integrated circuit or through other hardware such as a programmable gate array. In another example, module 150 may be implemented as module 150-2, which is implemented as computer program code 153 executed by the one or more processors 152. For instance, the one or more memories 155 and the computer program code 153 are configured, with the one or more processors 152, to cause the RAN node 170 to perform one or more of the operations as described herein. Note that the functionality of the module 150 may be distributed, such as being distributed between the DU 195 and the CU 196, or be implemented solely in the CU 196.

The one or more network interfaces 161 communicate over a network such as via the links 176 and 131. Two or more gNBs 170 may communicate using, e.g., link 176. The link 176 may be wired or wireless or both and may implement, for example, an Xn interface for 5G, an X2 interface for LTE, or other suitable interface for other standards.

The one or more buses 157 may be address, data, or control buses, and may include any interconnection mechanism, such as a series of lines on a motherboard or integrated circuit, fiber optics or other optical communication equipment, wireless channels, and the like. For example, the one or more transceivers 160 may be implemented as a remote radio head (RRH) 195 for LTE or a distributed unit (DU) 195 for gNB implementation for 5G, with the other elements of the RAN node 170 possibly being physically in a different location from the RRH/DU, and the one or more buses 157 could be implemented in part as, for example, fiber optic cable or other suitable network connection to connect the other elements (e.g., a centralized unit (CU), gNB-CU) of the RAN node 170 to the RRH/DU 195. Reference 198 also indicates those suitable network link(s).

It is noted that description herein indicates that "cells" perform functions, but it should be clear that equipment which forms the cell will perform the functions. The cell makes up part of a base station. That is, there can be multiple cells per base station. For example, there could be three cells for a single carrier frequency and associated bandwidth, each cell covering one-third of a 360° area so that the single base station's coverage area covers an approximate oval or circle. Furthermore, each cell can correspond to a single carrier and a base station may use multiple carriers. So, if there are three 120° cells per carrier and two carriers, then the base station has a total of six cells.

The wireless network 100 may include a network element or elements 190 that may include core network functionality, and which provides connectivity via a link or links 181 with a further network, such as a telephone network and/or a data communications network (e.g., the Internet). Such core network functionality for 5G may include access and mobility management function(s) (AMF(S)) and/or user plane functions (UPF(s)) and/or session management function(s) (SMF(s)). Such core network functionality for LTE may include MME (Mobility Management Entity)/SGW (Serving Gateway) functionality. These are merely exemplary functions that may be supported by the network element(s) 190, and note that both 5G and LTE functions might be supported. The RAN node 170 is coupled via a link 131 to a network element 190. The link 131 may be implemented as, for example, an NG interface for 5G, or an S1 interface for LTE, or other suitable interface for other standards. The network element 190 includes one or more processors 175, one or more memories 171, and one or more network interfaces (N/W I/F(s)) 180, interconnected through one or more buses 185. The one or more memories 171 include computer program code 173. The one or more memories 171 and the computer program code 173 are configured, with the one or more processors 175, to cause the network element 190 to perform one or more operations.

The wireless network 100 may implement network virtualization, which is the process of combining hardware and software network resources and network functionality into a single, software-based administrative entity, a virtual network. Network virtualization involves platform virtualization, often combined with resource virtualization. Network virtualization is categorized as either external, combining many networks, or parts of networks, into a virtual unit, or internal, providing network-like functionality to software containers on a single system. Note that the virtualized entities that result from the network virtualization are still implemented, at some level, using hardware such as processors 152 or 175 and memories 155 and 171, and also such virtualized entities create technical effects.

The computer-readable memories 125, 155, and 171 may be of any type suitable to the local technical environment and may be implemented using any suitable data storage technology, such as semiconductor-based memory devices, flash memory, magnetic memory devices and systems, optical memory devices and systems, fixed memory and removable memory. The computer-readable memories 125, 155, and 171 may be means for performing storage functions. The processors 120, 152, and 175 may be of any type suitable to the local technical environment, and may include one or more of general-purpose computers, special purpose computers, microprocessors, digital signal processors (DSPs) and processors based on a multi-core processor architecture, as non-limiting examples. The processors 120, 152, and 175 may be means for performing functions, such as controlling the UE 110, RAN node 170, and other functions as described herein.

In general, the various embodiments of the user equipment 110 can include, but are not limited to, cellular telephones such as smart phones, tablets, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, tablets with wireless communication capabilities, as well as portable units or terminals that incorporate combinations of such functions.

The user equipment 110 may also refer to Internet of Things (IoT) devices, massive industrial networks, smart city infrastructure, wearable devices, networked medical devices, autonomous devices, etc. These types of UE devices may operate for extended periods of time without human intervention (e.g., perform maintenance, replace or recharge an on-device battery, etc.), may have reduced processing power and/or memory storage, may have reduced battery storage capability due to having small form factors, may be integrated into machinery (e.g., heavy machinery, factory machinery, sealed devices, etc.), may be installed/located in hazardous environment or difficult to access environments, etc.

Figure 2:
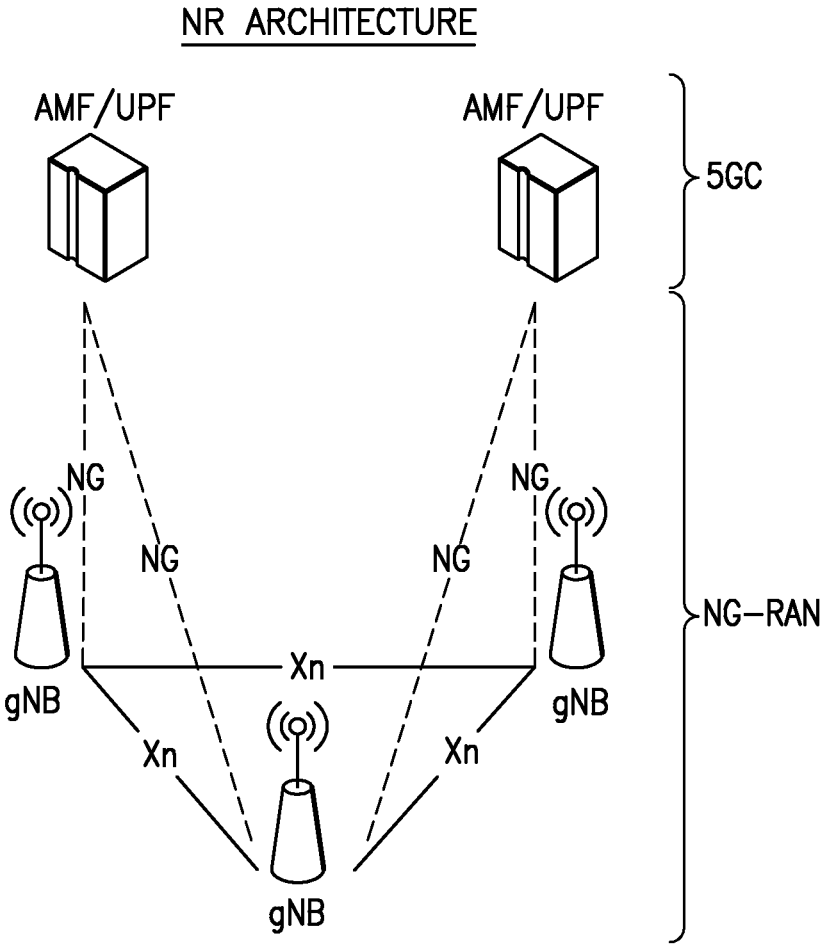
FIGS. 2 and 3 show an example of New Radio (NR) architecture having the 5G core (5GC) and the NG-RAN.
Figure 3:
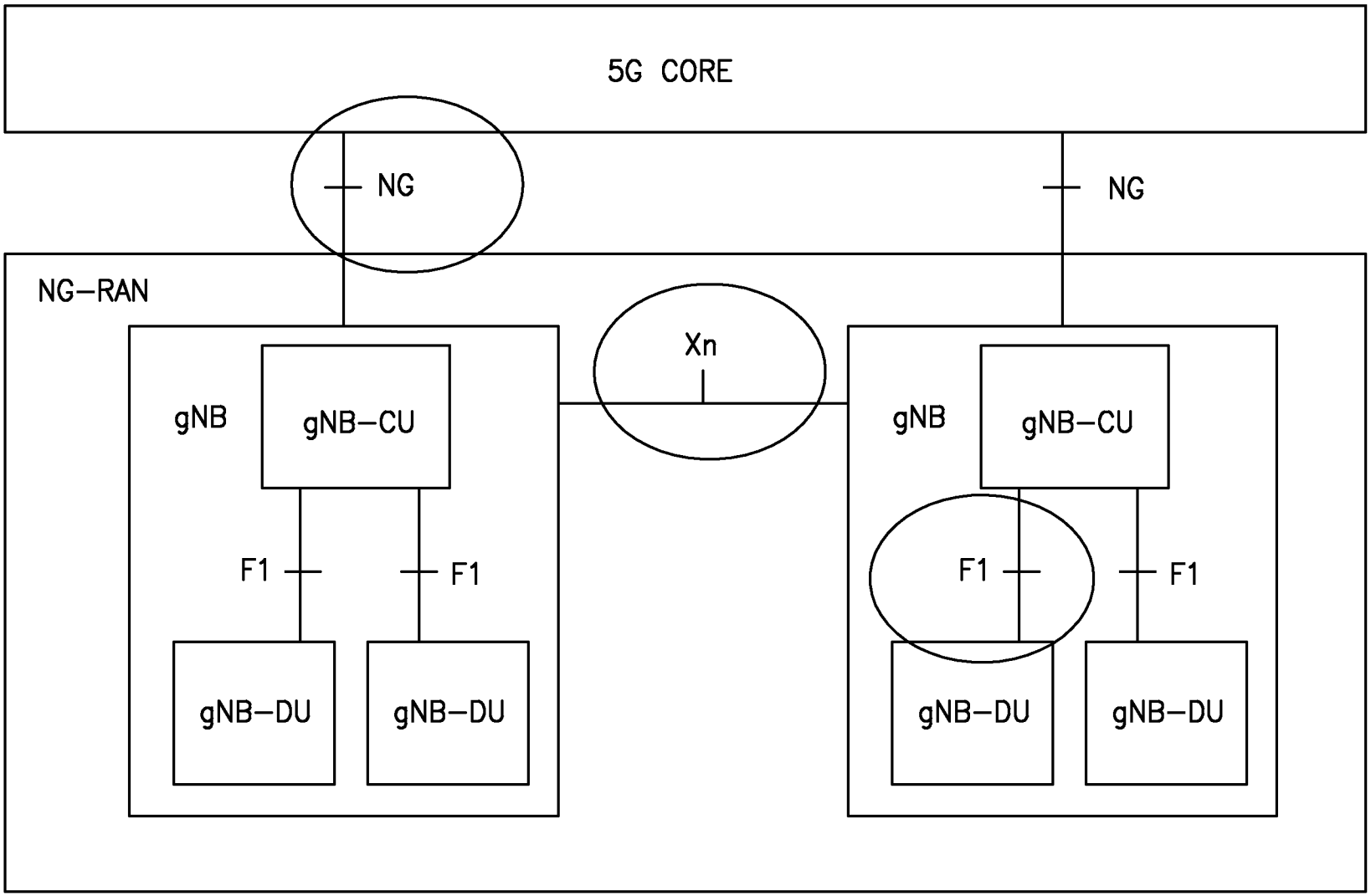

FIGS. 2 and 3 show an example of New Radio (NR) architecture having the 5G core (5GC) and the NG-RAN. The base stations gNB are coupled to the 5GC by the interface to core NGs, and the gNBs are coupled to each other by the inter-base station interface Xn.

In the present disclosure, an improvement for a balun configuration for "tripod" radiating elements is proposed. A balun is an electrical device that converts between a balance signal and an unbalance signal, such as by balancing or unbalancing the feeding currents of a system, in the present case, radiating elements. See https://en.wikipedia.org/wiki/Balun.

A shortcoming of present designs for "tripod" dual-polarized radiating element arrangements is that the currents of the +45° and −45° slanted channels are not conveniently balanced with each other. This leads to high couplings between the ports of the radiating elements, and, consequently, weak port-to-port isolation values.

In order to improve the decoupling performance, not only must the currents and associated transformation impedances be balanced, but, in addition, improved isolation values must be reached by orienting the parts of the radiating elements in an improved manner.

Figure 4:
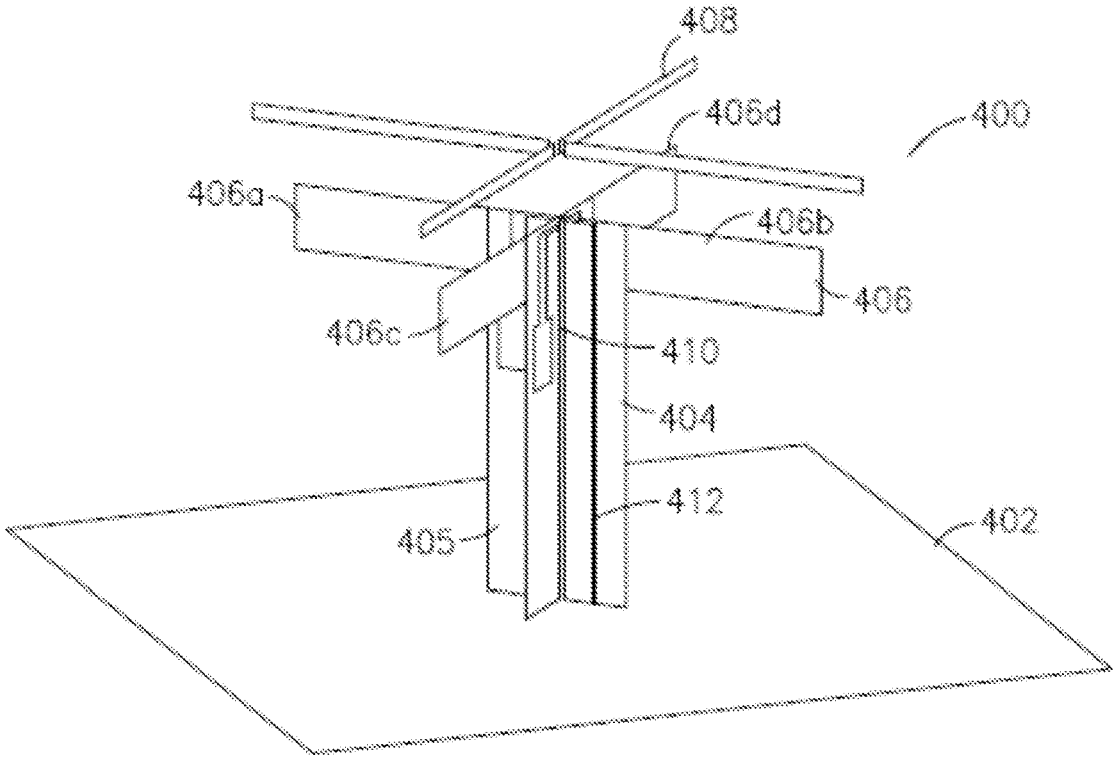
FIG. 4 (Prior Art)
FIG. 4 schematically shows a perspective view of a conventional dual-polarized slanted dipole.

FIG. 4 schematically shows a perspective view of a conventional dual-polarized slanted dipole 400. The dipole 400 includes a ground plane 402, a central support 404, and four radiating arms 406. More specifically, dipole 400 is actually a double dipole in the form of two crossed dipoles, each including the two radiating arms 406 oriented in the same direction; that is to say, radiating arms 406*a*, 406*b* form one of the crossed dipoles and radiating arms 406*c*, 406*d* form the other of the crossed dipoles. The dipole 400 extends 115 mm from the ground plane 402 to the top of the radiating arms 406, and 170 mm across from the end of one of the radiating arms 406 to the end of the opposite radiating arm 406. The radiating arms 406 each have a director 408. Directors 408 are shown in FIG. 4 as being separated from their respective radiating arms 406 for the sake of clarity. In actuality, the directors 408 are physically attached to their respective radiating arms 406 by printed-circuit-board or plastic material, as will be illustrated below in FIGS. 21 to 26. That is to say, radiating arms 406 and directors 408 may be conductive tracks on the printed circuit board. Directors 408 are used here and in the exemplary embodiments to be described below to tune and broaden the related [S] performances.

The central support 404, in this dipole 400, is shared by the radiating arms 406. The central support 404 includes two feeding probes 405, each having two parts, one for each of the radiating arms 406. Each of the two parts of feeding probes 405 is separated from the others by a gap 410. The feeding probes include feed lines 412, which cross gap 410 to reach the other radiating arm 406 of a given pair making up a dipole.

Figure 5:
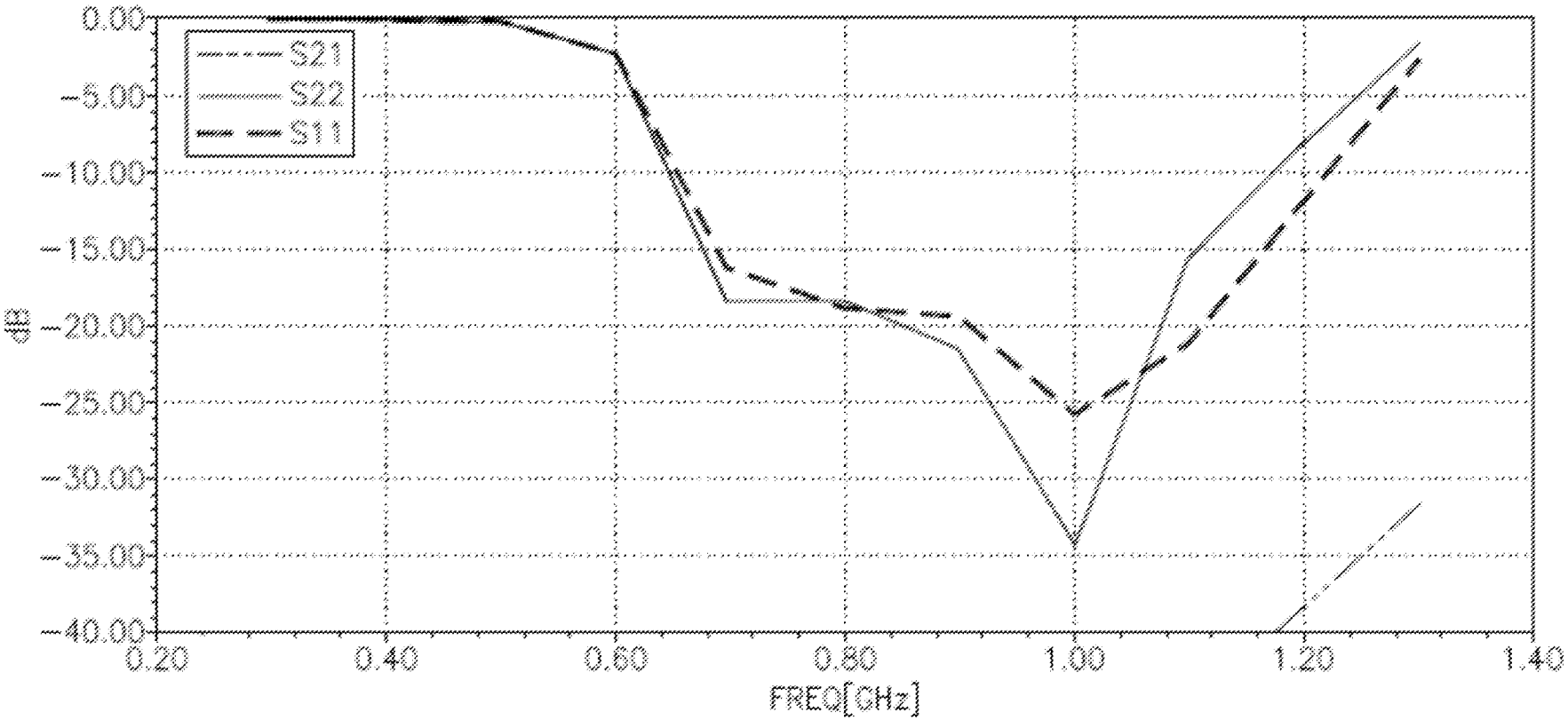
FIG.5 (Prior Art)
FIG. 5 graphically illustrates the tuning of the dipole shown in FIG. 4.

Dipole 400 is designed and tuned to perform around 0.7 to 1 GHz, as is shown graphically in FIG. 5. More precisely, dipole 400 is tuned to operate within the 694 to 960 MHz band, which is part of the so-called Low Band (LB) from approximately 500 MHz to 6000 MHz.

When actually in use, the conventional dual-polarized slanted dipole 400 is oriented such that the ground plane 402 is mounted vertically, the central support 404 is then horizontal, and the radiating arms 406 are located in a vertical plane. For this reason, the radiating arms 406 may alternately be described as vertical arms.

Figure 6:
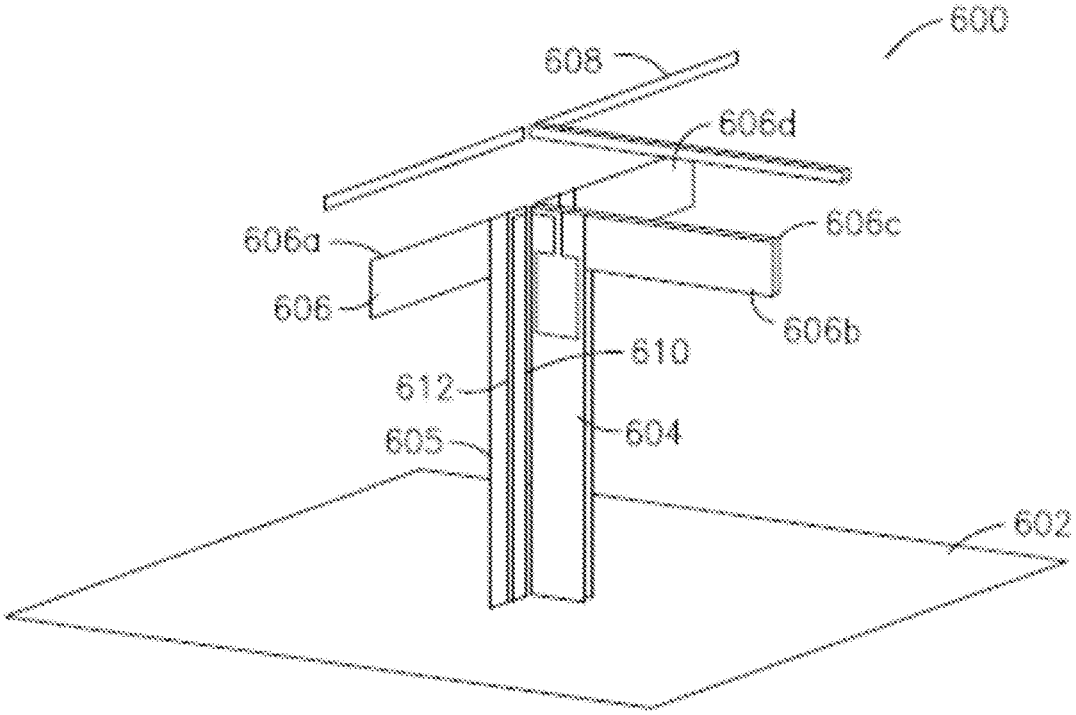
FIG. 6 (Prior Art)
FIG. 6 schematically shows a perspective view of a conventional "tripod" radiating device.

FIG. 6 schematically shows a perspective view of a conventional "tripod" radiating device 600 tuned to the same frequency band, around 0.7 to 1 GHz. The conventional "tripod" radiating device 600 includes a ground plane 602, a central support 604, and four radiating arms 606. Two of the four radiating arms 606*b*, 606*c* are parallel to one another; the other two radiating arms 606*a*, 606*d* extend in opposite directions perpendicular to the two parallel radiating arms 606*b*, 606*c*. The device 600 extends 130 mm from the ground plane 602 to the top of the radiating arms 606, and 190 mm across from the end of radiating arm 606*a* to the end of radiating arm 606*d*. Each of the radiating arms 606 has a director 608, which is as described above.

Figure 7:
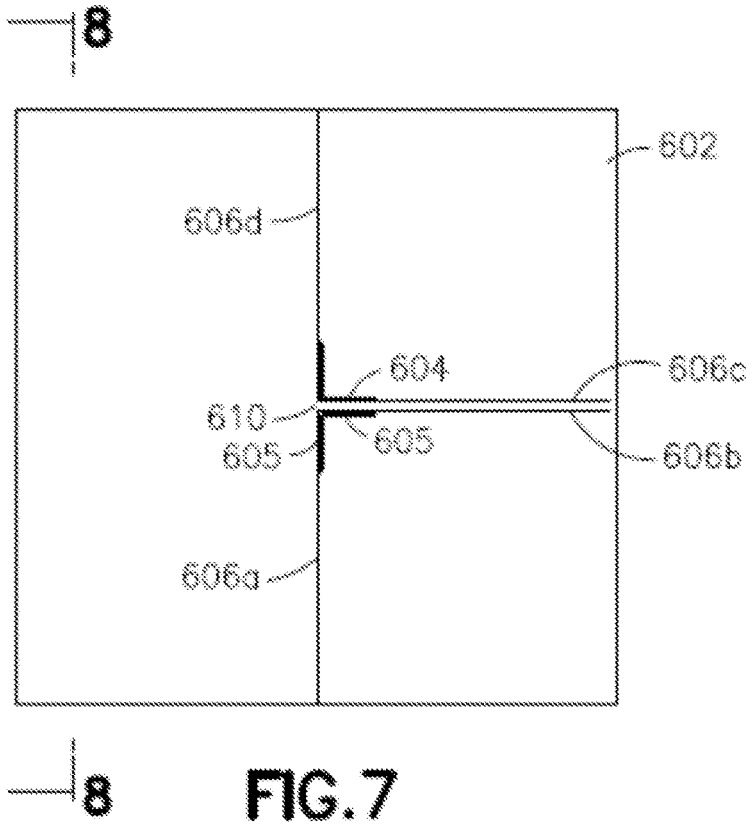
FIG.7 (Prior Art)
FIG. 7 is a view from above the device shown in FIG. 6.
Figure 8:
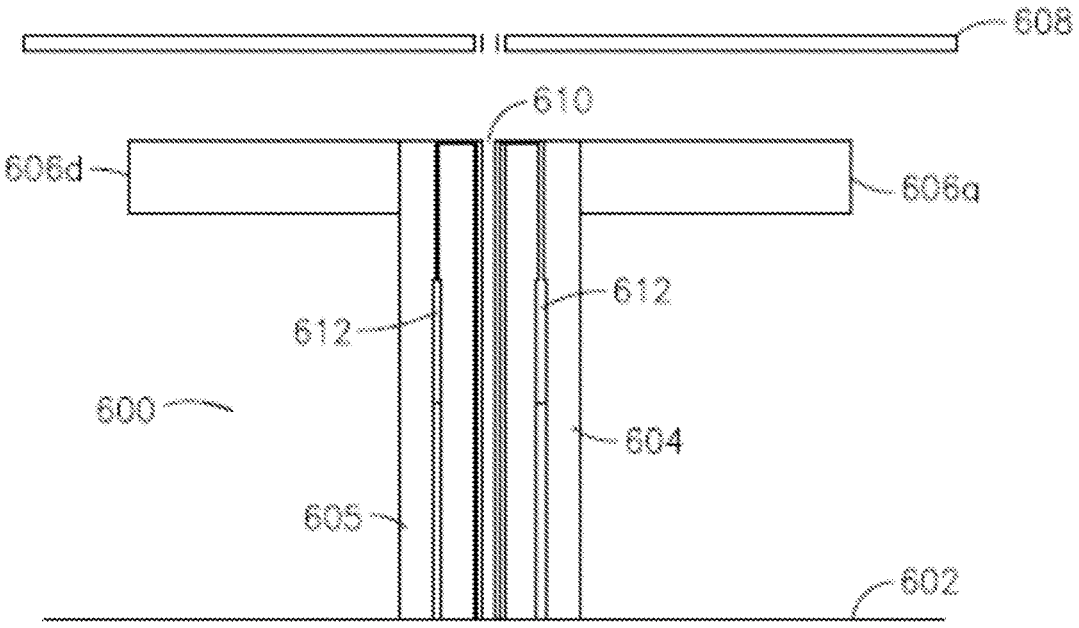
FIG.8 (Prior Art)
FIG. 8 is a view from the side of the device shown in FIG. 6, taken as indicated in FIG. 7.

The central support 604, in this device 600, is split, as shown in FIG. 7, which is a plan view of the device 600 taken perpendicularly from above ground plane 602, and as shown in FIG. 8, which is a side view of the device 600 taken as indicated in FIG. 7. In FIG. 7, it is apparent that radiating arms 606*b*, 606*c* are parallel to one another, while the other two radiating arms 606*a*, 606*d* extend in opposite directions from the central support 604.

The central support 604 again includes two feeding probes 605, each having two parts, one for each of the radiating arms 606. Each of the parts of the feeding probes 605 is separated from the others by a gap 610. The feeding probes 605 include feed lines 612, which do not cross gap 610 to reach the other radiating arm 606 of a given pair making up the device 600. More specifically, radiating arms 606*a*, 606*b* form one of the dipoles and radiating arms 606*c*, 606*d* form the other dipole.

Figure 9:
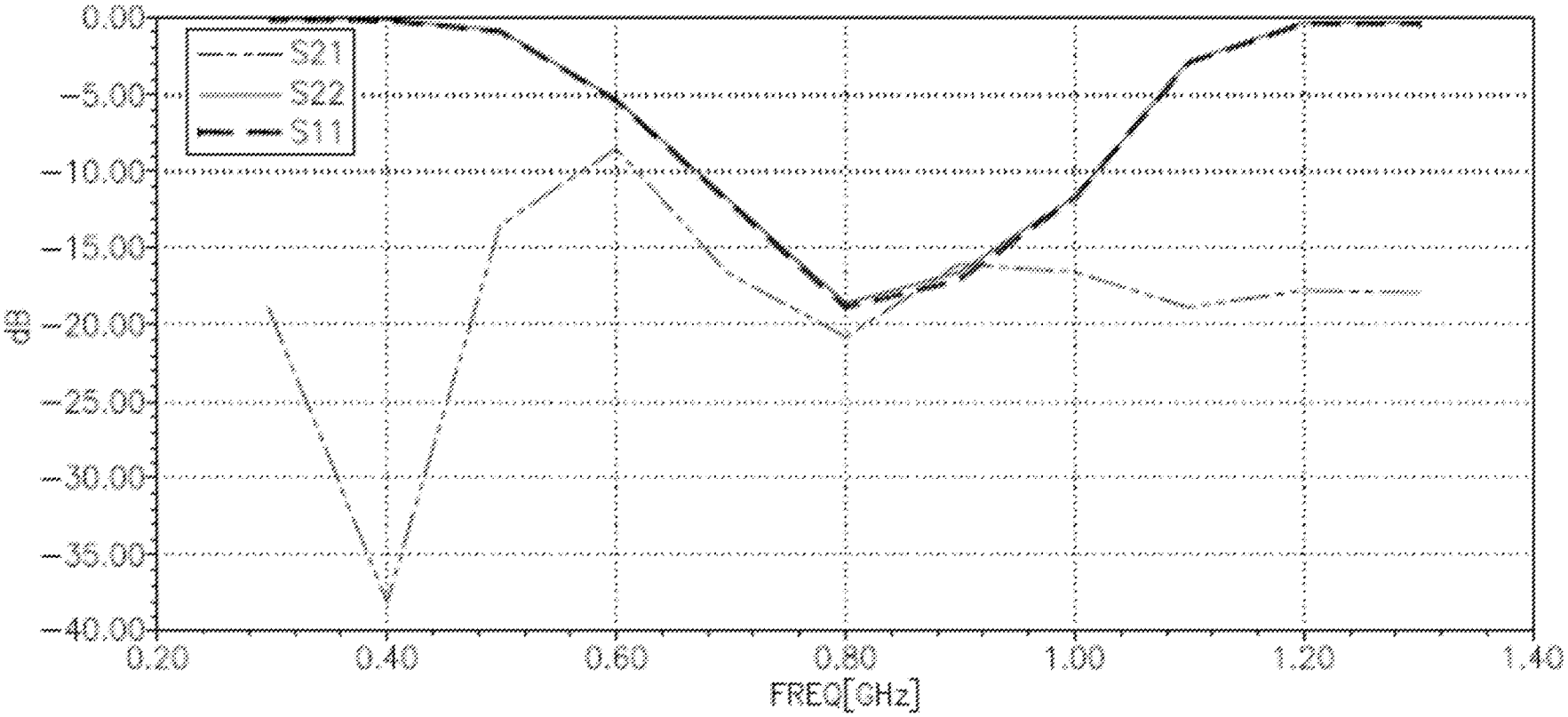
FIG.9 (Prior Art)
FIG. 9 graphically illustrates the tuning of the device shown in FIGS. 6, 7, and 8.

As indicated above, device 600 is designed and tuned to perform in the same frequency band, around 0.7 to 1 GHz, as is shown graphically in FIG. 9. However, compared to a conventional mechanically slanted dual-polarized dipole like dipole 400, [S] performances are degraded: frequency bandwidth is shrunk, and isolation between the two access ports is reduced from more than 40 dB initially to about 15 dB on average within the 0.7 to 1 GHz band.

The current exemplary embodiments are designed to improve the balance of the feeding circuitry in order to reach better port-to-port isolation values. To achieve this result, the central support is fully split.

Figure 10:
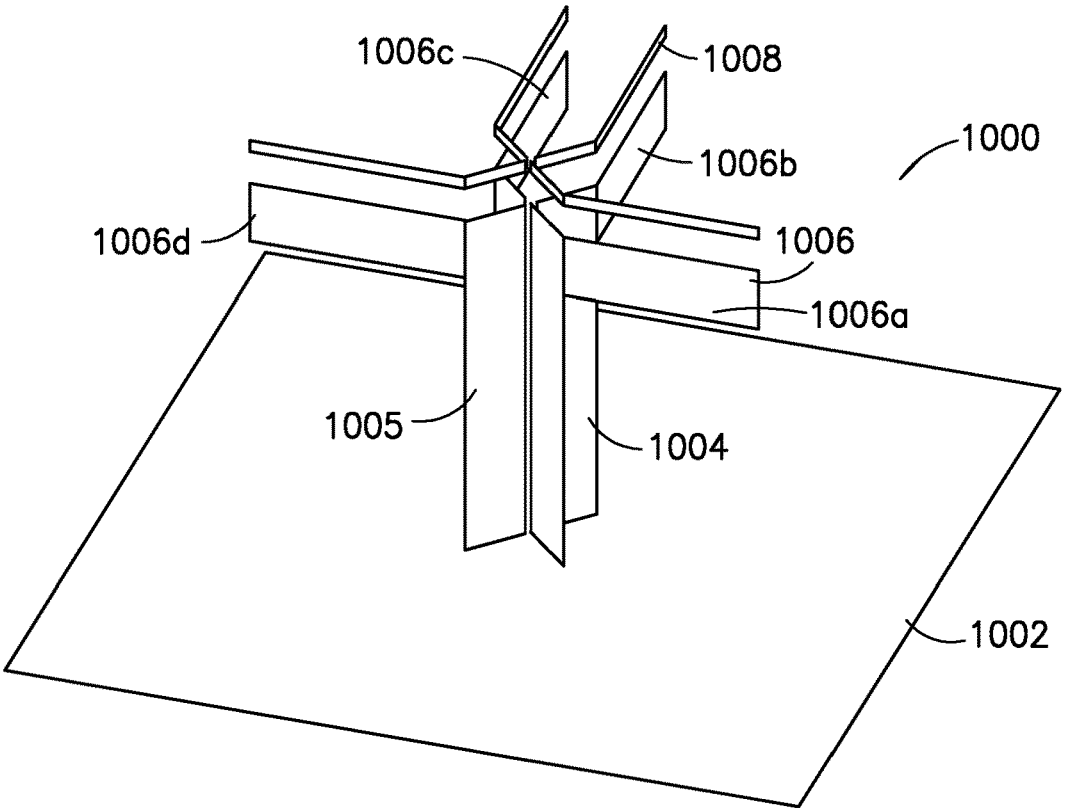
FIG. 10 schematically shows a perspective view of a first exemplary embodiment of a device of the present disclosure.

In a first exemplary embodiment, shown in a perspective view on ground plane 1002 in FIG. 10, the central support 1004 of the device 1000 is made up of two feeding probes 1005, which each have two aligned parts, and which cross those of the other feeding probe at a 90° angle. Moreover, the intersection between the feeding probes 1005 making up the central support 1004 is split or open. The radiating arms 1006 again each have a director 1008, which is as described above.

Figure 11:
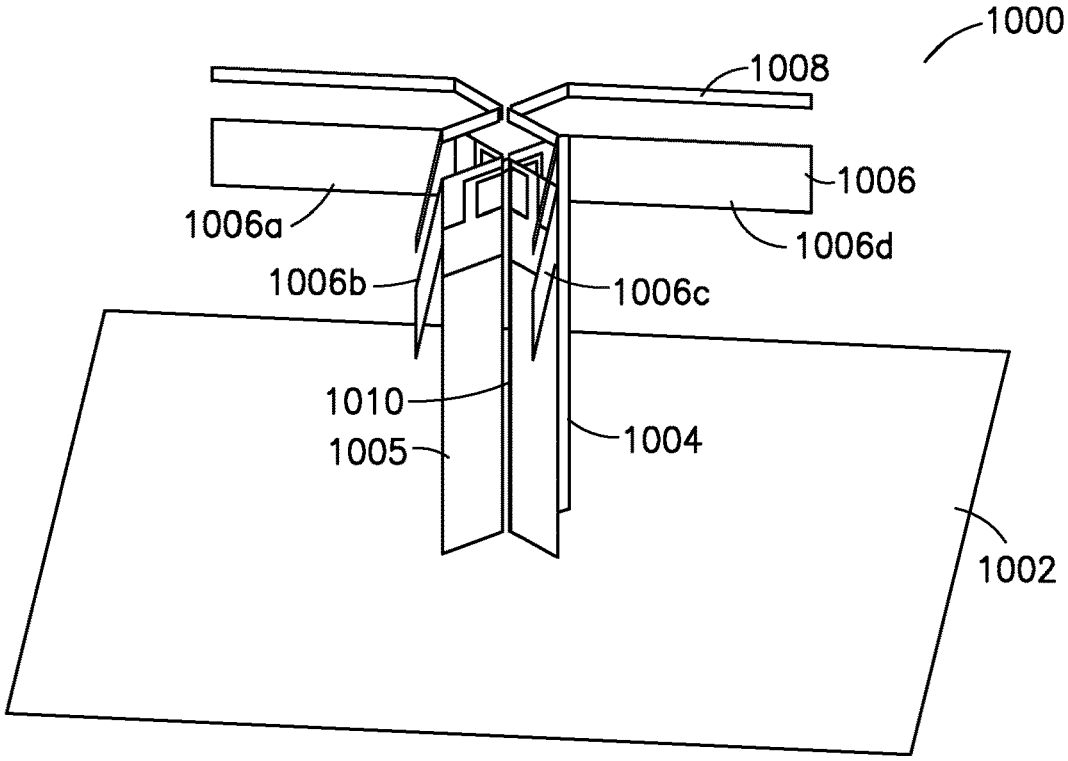
FIGS. 11 and 12 are perspective views of the device from alternate directions relative to that of FIG. 10.
Figure 12:
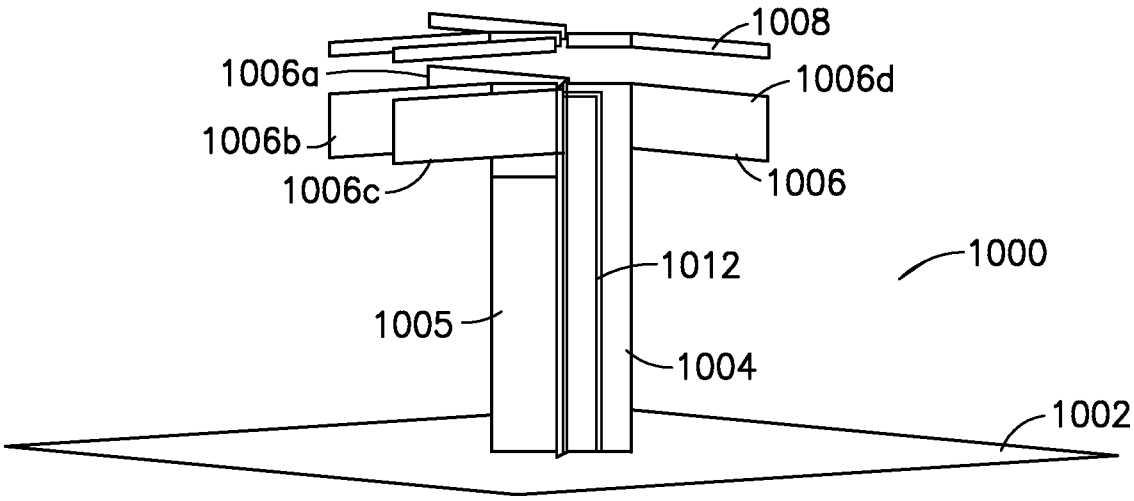

The central support 1004 includes two feeding probes 1005, each having two parts, one for each of the radiating arms 1006. Each of the parts of the feeding probes 1005 is separated from the others by a gap 1010. The feeding probes include feed lines 1012, which cross gap 1010 to reach the other radiating arm 1006 of a given pair making up a dipole. More specifically, radiating arms 1006*a*, 1006*c* form one of the dipoles and radiating arms 1006*b*, 1006*d* form the other dipole. FIGS. 11 and 12 are perspective views of the device 1000 from alternate directions relative to that of FIG. 10.

Figure 13:
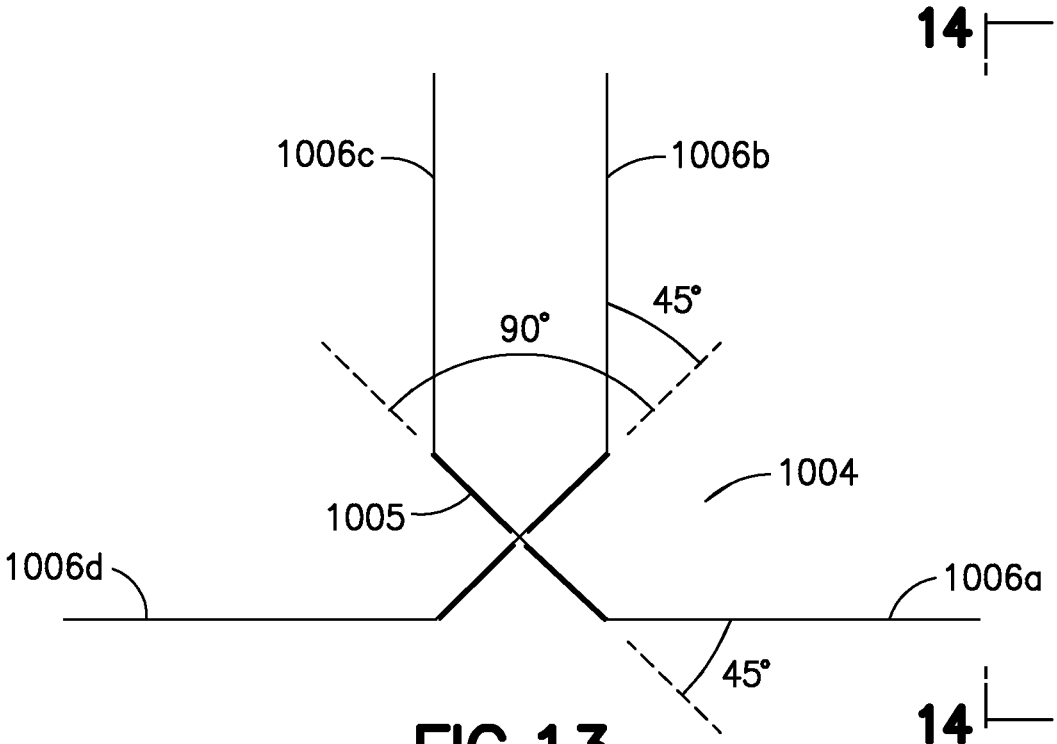
FIG. 13 is a view from above the device shown in FIGS. 10, 11, and 12.

FIG. 13 is a plan view of the device 1000 viewed perpendicularly from above ground plane 1002 showing that the feeding probes 1005 making up the central support 1004 form an angle of 90° with respect to one another. Moreover, two radiating arms 1006*b*, 1006*c* are aligned with one another, making angles of 45° relative to their respective feeding probes 1005. The other two radiating arms 1006*a*, 1006*d* are oriented in opposite directions to one another, each making an angle of 45° relative to their respective feeding probes 1005, and each being perpendicular to the two parallel radiating arms 1006*b*, 1006*c*.

Figure 14:
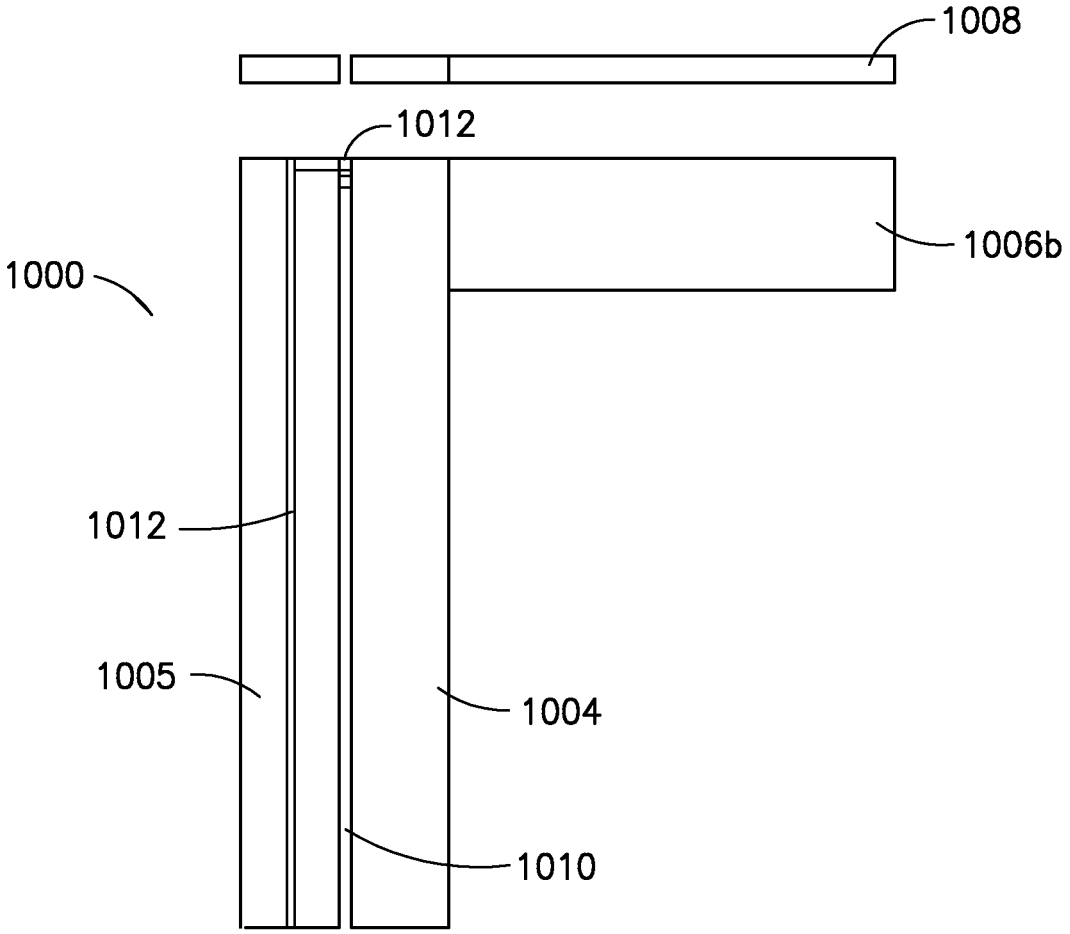
FIG. 14 is a side view of the device shown in FIGS. 10, 11, and 12, taken as indicated in FIG. 13.

FIG. 14 is a side view of the device 1000 taken as indicated in FIG. 13. There, feedlines 1012 for the dipoles formed by radiating arms 1006*a*, 1006*c* and radiating arms 1006*b*, 1006*d* are shown crossing gap 1010.

Figure 15:
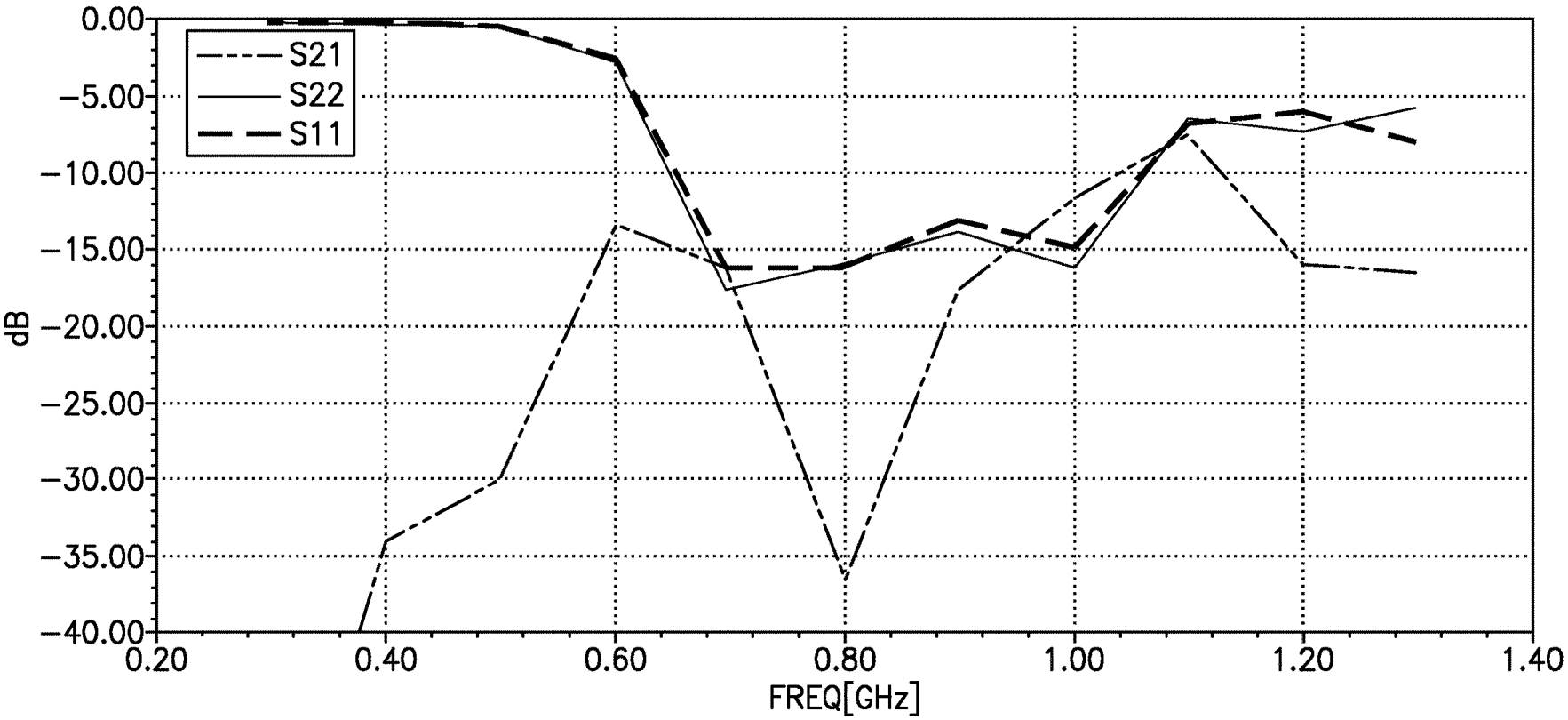
FIG. 15 graphically illustrates the tuning of the device shown in FIGS. 10 to 14.

FIG. 15 graphically illustrates the tuning of the device shown in FIGS. 10 to 14. It can be seen in FIG. 15 that the operational bandwidth of dipole 1000 has been increased, based on S11 and S22, and the average port-to-port isolation has been improved from −15 dB initially to about −20 dB, averaged within the 0.7 to 1 GHz band.

Figure 16:
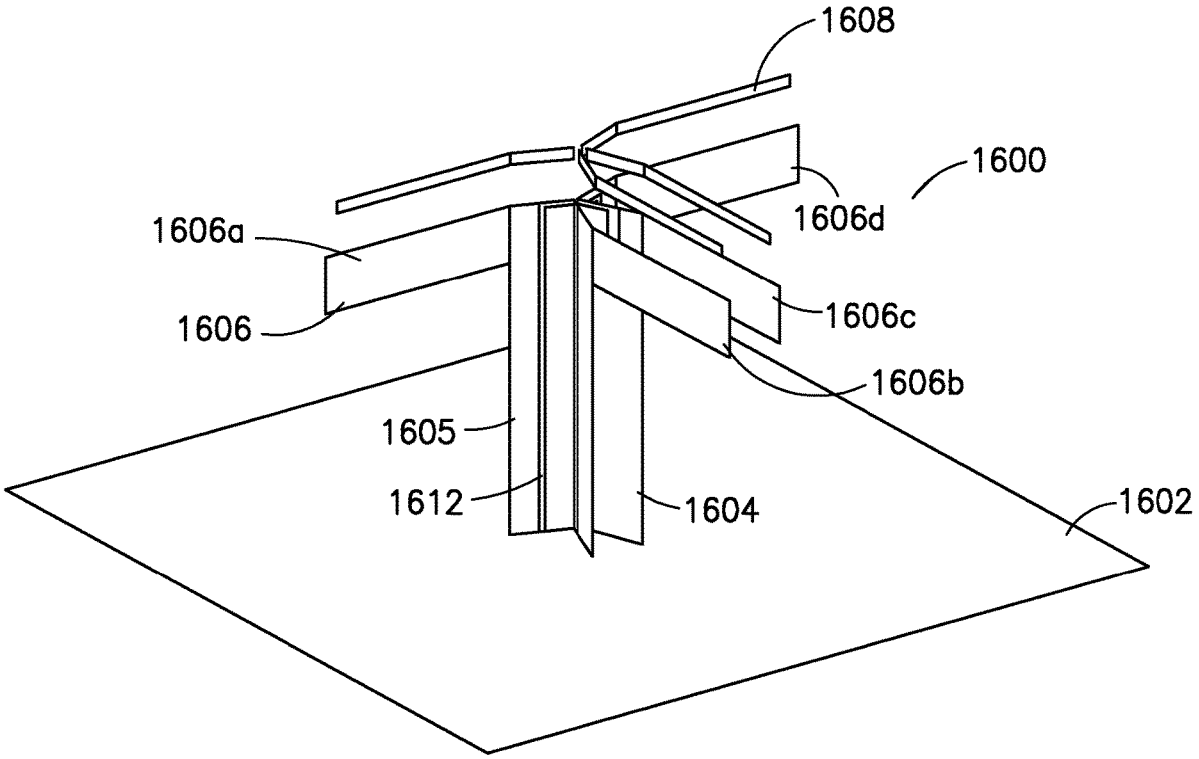
FIG. 16 schematically shows a perspective view of a second exemplary embodiment of a device of the present disclosure.

In a second exemplary embodiment, shown in a perspective view on ground plane 1602 in FIG. 16, the achieved performance can be further improved by modifying the angles formed at the gap 1610 between the parts of the feeding probes 1605. There, the central support 1604 of the device 1600 is characterized by oblique angles. Moreover, the intersection between the parts of the feeding probes 1605 making up the central support 1604 is split or open. The radiating arms 1606 are joined to their respective parts of the feeding probes 1605, and again each have a director 1608, which is as described above.

The central support 1604 includes two feeding probes 1605, each of which has two parts, one for each of the radiating arms 1606. The two parts of each feeding probe 1605 are not aligned with one another. Each of the parts of the feeding probes 1605 is separated from the others by a gap 1610, which is seen most clearly in FIGS. 18 and 19. The feeding probes 1605 include feed lines 1612, which cross gap 1610 to reach the other radiating arm 1606 of a given pair making up a dipole. More specifically, radiating arms 1606*a*, 1606*c* form one of the dipoles and radiating arms 1606*b*, 1606*d* form the other dipole.

Figure 17:
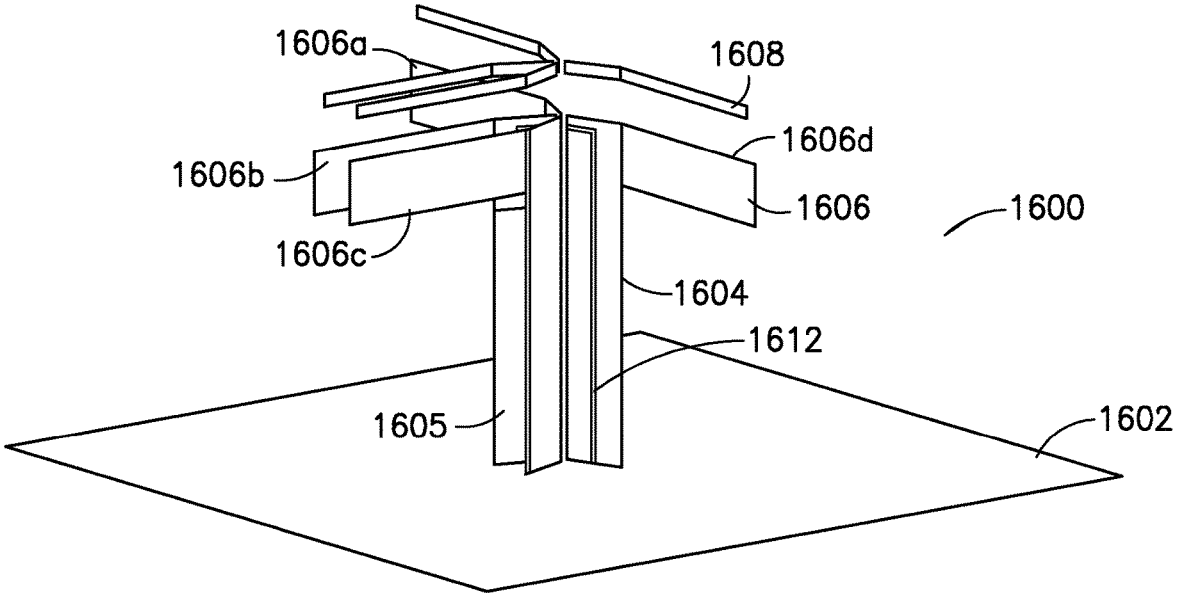
FIG. 17 is a perspective view of the device from an alternate direction relative to that of FIG. 16.

FIG. 17 is a perspective views of the device 1600 from an alternate direction relative to that of FIG. 16.

Figure 18:
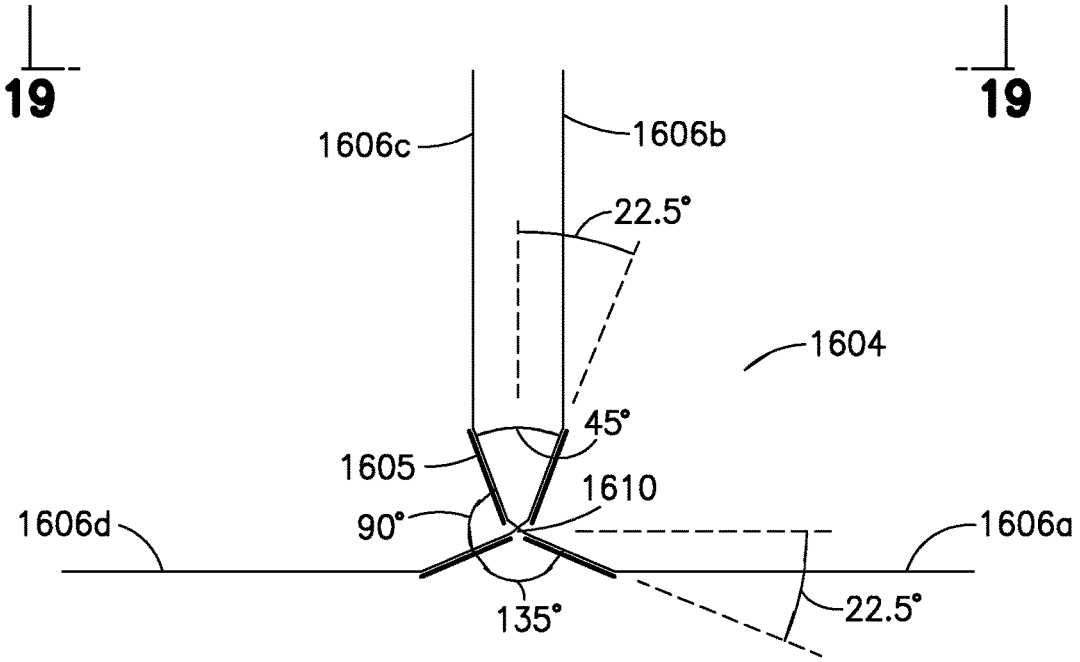
FIG. 18 is a view from above the dipole shown in FIGS. 16 and 17.

FIG. 18 is a plan view of the device 1600 viewed perpendicularly from above ground plane 1602 showing that the feeding probes 1605 making up the central element 1604 form oblique angles. More specifically, pairs of adjacent feeding probes 1605 are oriented perpendicularly to one another, while angles of 45° and 135° separate the perpendicular pairs from one another. Moreover, two radiating arms 1606*b*, 1606*c* are parallel to one another, making angles of 22.5° relative to their respective feeding probes 1605. The other two radiating arms 1606*a*, 1606*d* are oriented in opposite directions to one another, each making an angle of 22.5° relative to their respective feeding probes 1605, and each being perpendicular to the two parallel radiating arms 1606*a*, 1606*d*.

Figure 19:
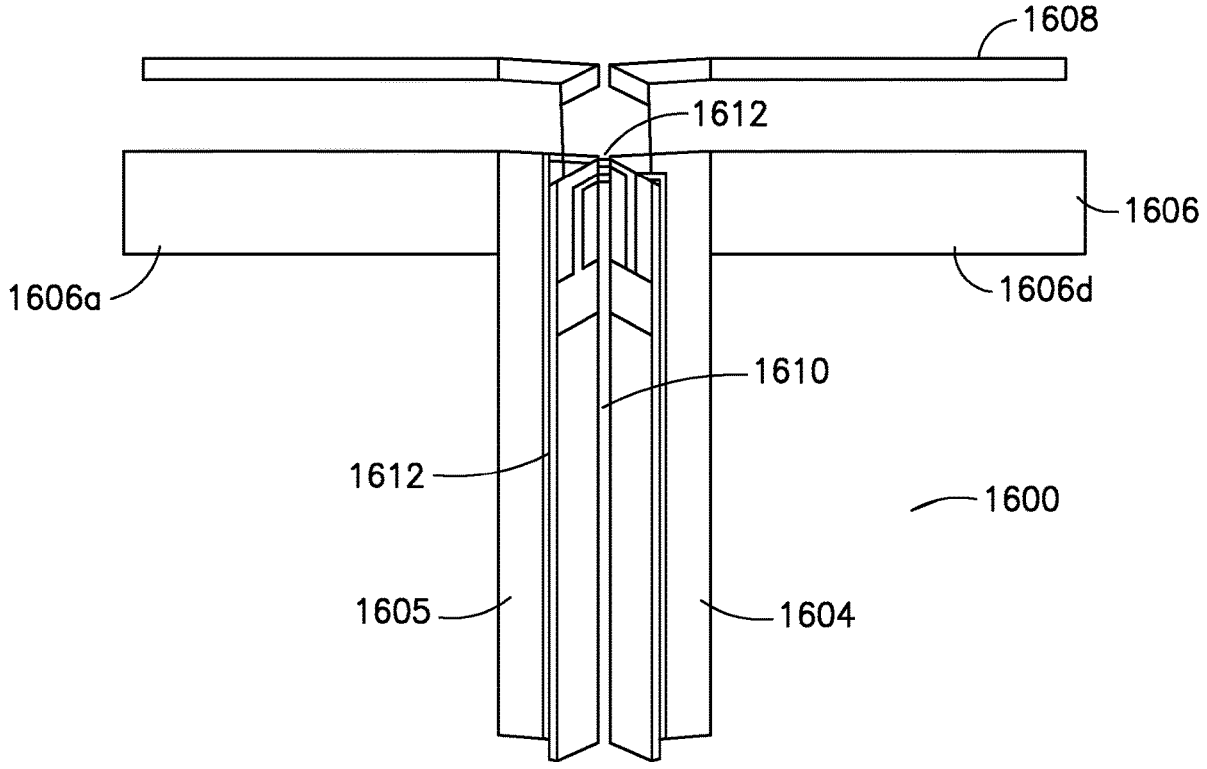
FIG. 19 is a side perspective view of the device shown in FIGS. 16 and 17, taken as indicated in FIG. 18.
Figure 20:
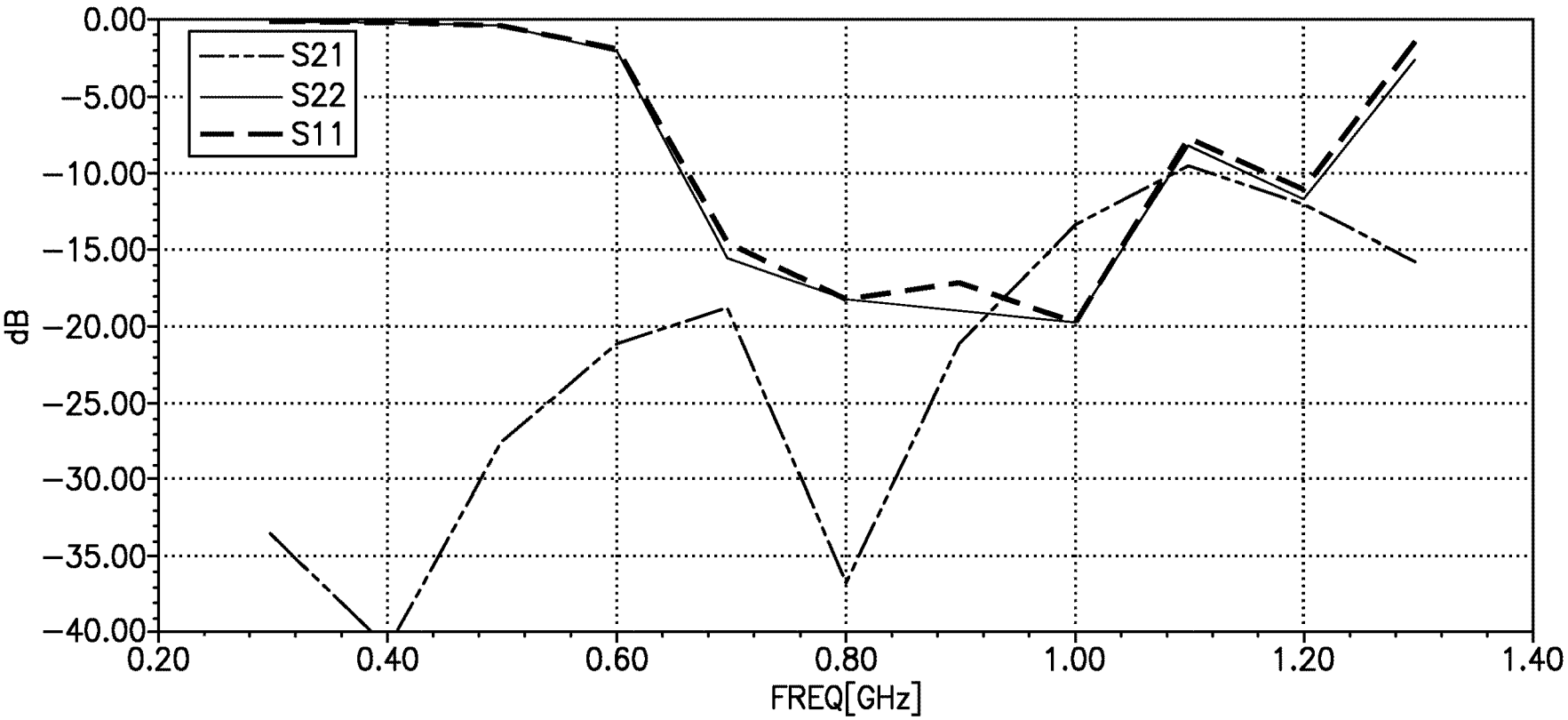
FIG. 20 graphically illustrates the tuning of the dipole shown in FIGS. 16 to 19.

FIG. 19 is a side perspective view of the device 1600 taken as indicated in FIG. 18. There, feedlines 1612 for the dipoles formed by radiating arms 1606*a*, 1606*c* and radiating arms 1606*b*, 1606*d* are shown crossing gap 1610. FIG. 20 graphically illustrates the tuning of the device shown in FIGS. 16 to 19. Compared to the results shown in FIGS. 9 and 15, the averaged port-to-port isolation improved from −15 dB to about −20 dB, and then to about −25 dB averaged within the 0.7-1 GHz band.

FIGS. 21 to 26 illustrate other potential variations of such "tripod" arrangements for the purpose of compactness and greater integration and aggregation of the same or different frequency bands in one antenna. Each of FIGS. 21 to 26 shows an array of four devices which fall within the teachings of the present disclosure.

Figure 21:
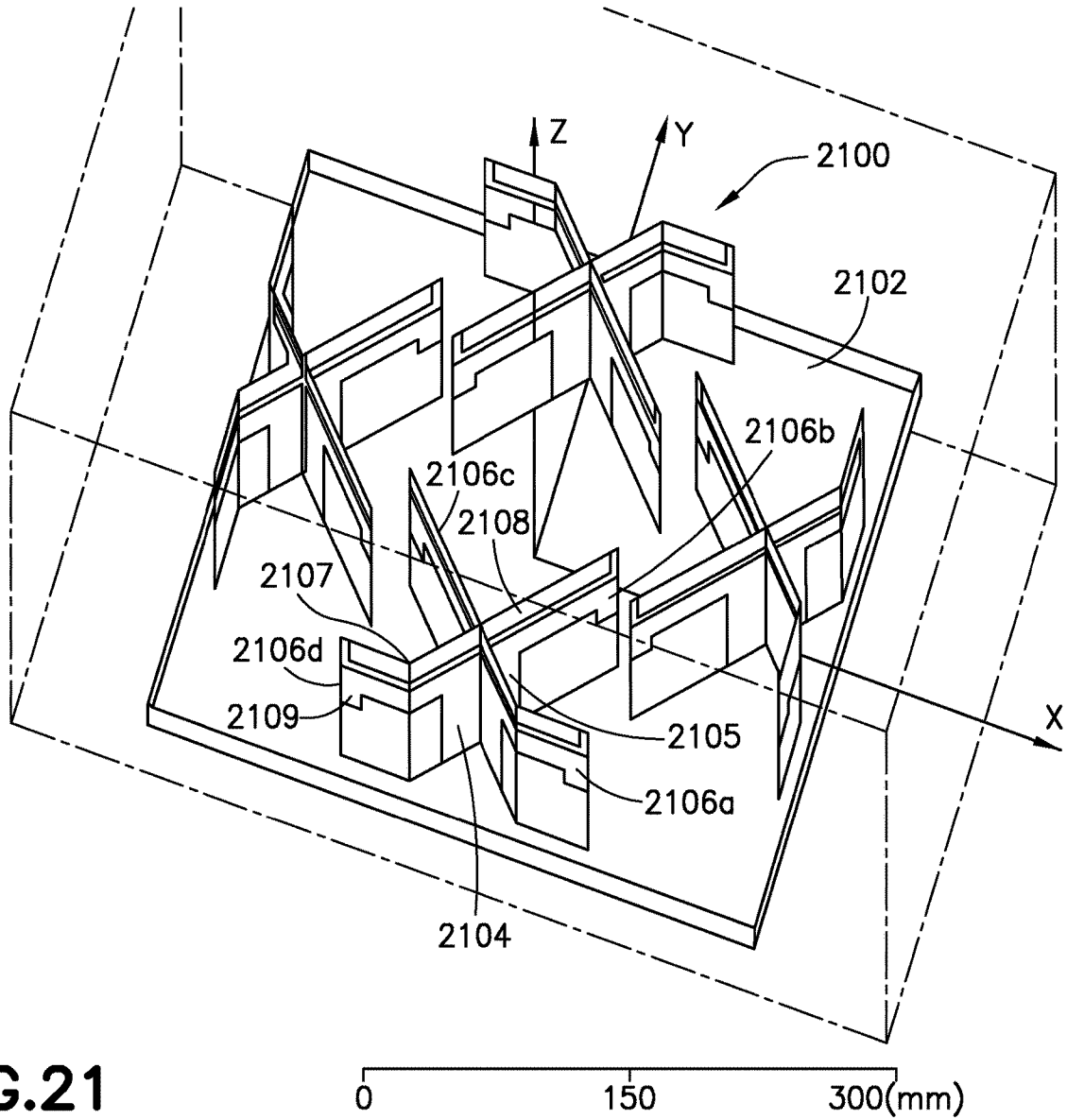
FIGS. 21 to 26 show other potential variations of "tripod" arrangements.

Referring first to FIG. 21, four devices 2100 are arrayed on a common ground plane 2102. Each of the four devices 2100 is based on device 1000 shown in FIGS. 10 to 14, although radiating arms 2106 do not form a "tripod." Instead, radiating arms 2106*a*, 2106*d* do not take orientations directly opposite to one another at central support 2104, but take the same orientation as their respective parts of feeding probes 2105 up to points 2107, from which radiating arms 2106*a*, 2106*d* are oriented in opposite directions to one another. In contrast, radiating arms 2106*b*, 2106*c* take the same orientation as their respective parts of feeding probes 2105 without any change in direction. It should be noted that directors 2108 are shown in FIG. 21, and that radiating arms 2106 have terminal extensions 2109 at their distal ends.

Devices 2100 are arranged on their common ground plane 2102 such that radiating arms 2106*a*, 2106*d* are outward of the center of the array formed by the four devices 2100.

Figure 22:
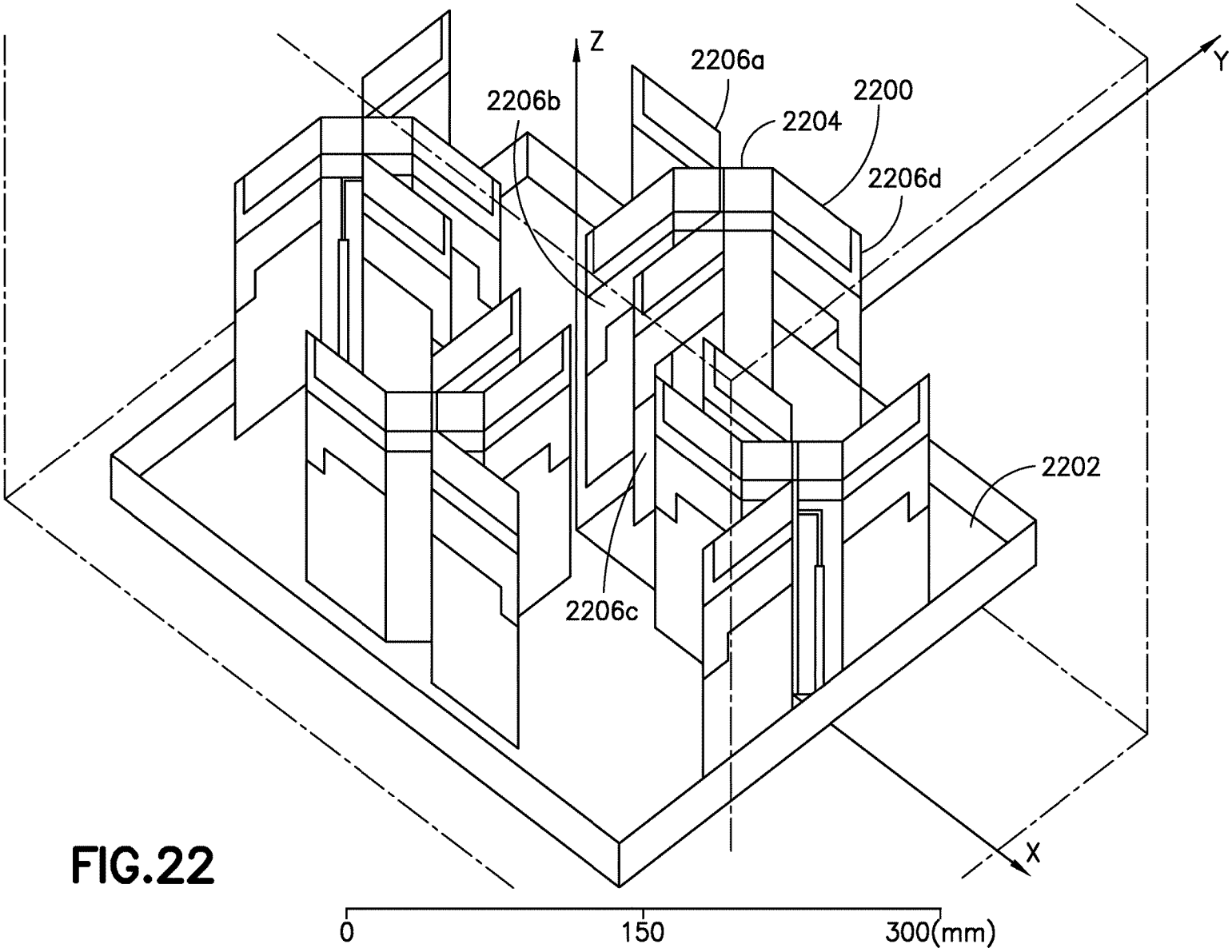

FIG. 22 shows four devices 2200 arrayed on a common ground plane 2202. Each of the four devices 2200 is substantially the same as device 1000 shown in FIGS. 10 to 14. Radiating arms 2206*a*, 2206*d* take orientations directly opposite to one another at central support 2204. As in FIGS. 10 to 14, radiating arms 2206*b*, 2206*c* are aligned parallel to one another from their respective parts of feeding probes 2205.

Devices 2200 are arranged on their common ground plane 2202 such that radiating arms 2206*a*, 2206*d* are outward of the center of the array formed by the four devices 2200, and the radiating arms 2206*b*, 2206*c*, which are parallel to one another for each device 2200, are oriented toward the center of the array.

Figure 23:
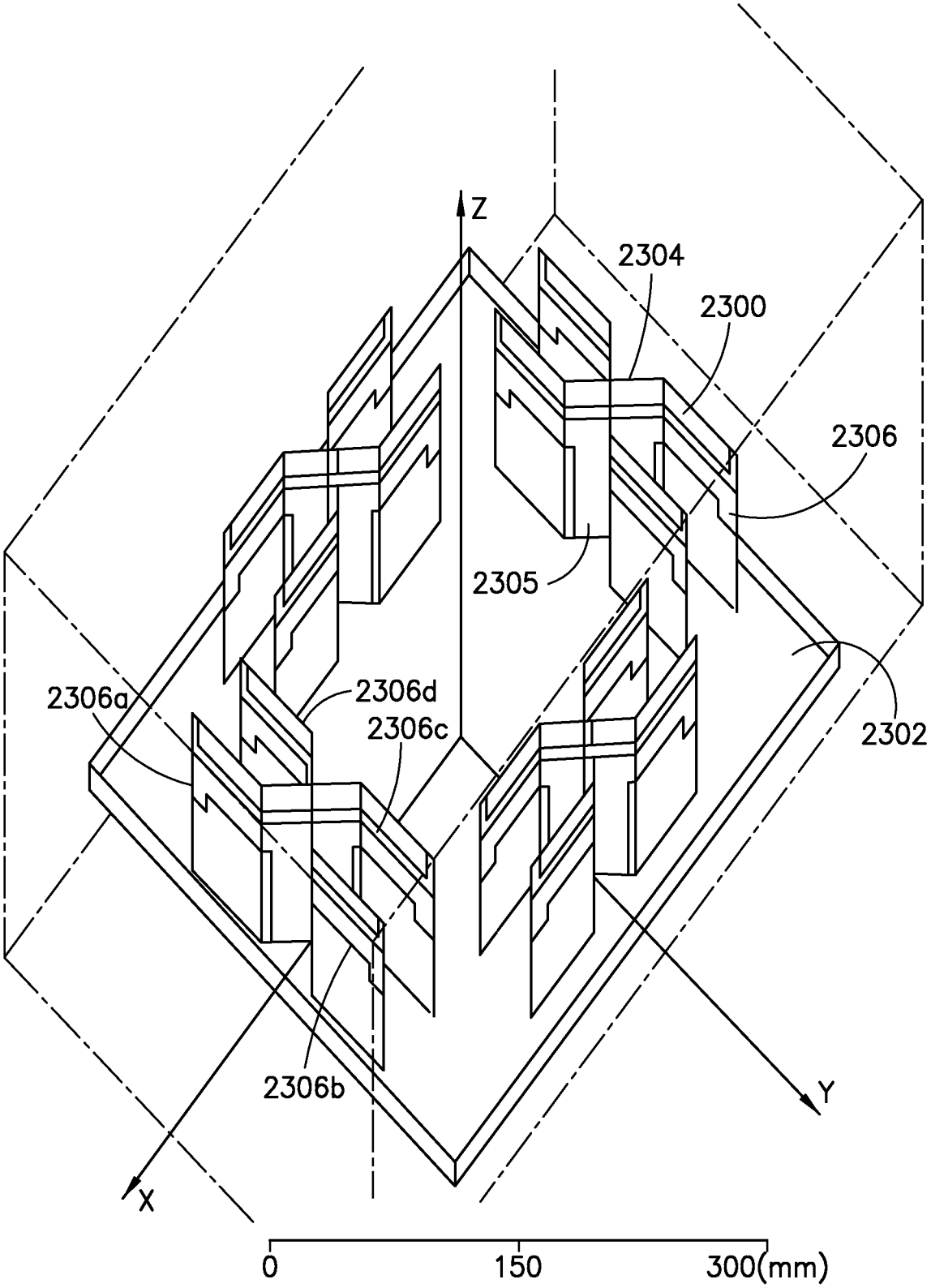

FIG. 23 shows four devices 2300 arrayed on a common ground plane 2302. Each of the four devices 2300 is based on device 1000 shown in FIGS. 10 to 14, although radiating arms 2306 do not form a "tripod." Instead, radiating arms 2306*a*, 2306*d* do not take orientations directly opposite to one another at central support 2304, but take orientations parallel to one another from their respective parts of feeding probes 2305. In the same way, radiating arms 2306*b*, 2306*c* also are aligned parallel to one another from their respective parts of feeding probes 2305, as they are in FIGS. 10 to 14. As a consequence, radiating arms 2304*a*, 2304*b* are aligned with one another, as are radiating arms 2304*c*, 2304*d*.

Devices 2300 are arranged on their common ground plane 2302 such that radiating arms 2306*a*, 2306*b*, 2306*c*, 2306*d* are oriented in directions perpendicular to that oriented toward the center of the array formed by the four devices 2300.

Figure 24:
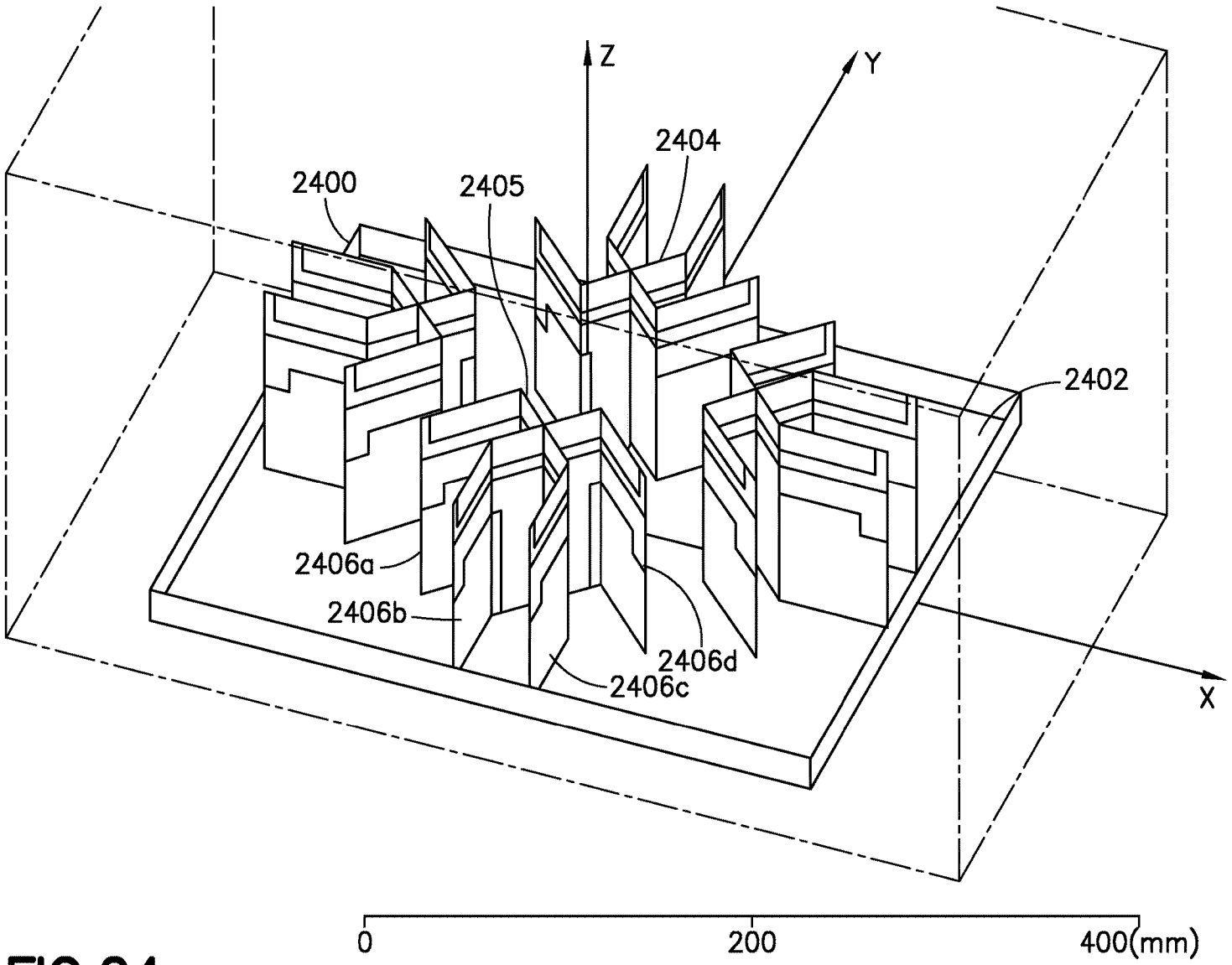

FIG. 24 shows four devices 2400 arrayed on a common ground plane 2402. Each of the four devices 2400 is based on device 1000 shown in FIGS. 10 to 14, although radiating arms 2406 do not form a "tripod." Instead, radiating arms 2406*a*, 2406*d* do not take orientations directly opposite to one another at central support 2604, but take orientations perpendicular to their respective parts of feeding probes 2405. Radiating arms 2406*b*, 2406*c* are aligned parallel to one another from their respective parts of feeding probes 2405, as they are in FIGS. 10 to 14.

Devices 2400 are arranged on their common ground plane 2402 such that radiating arms 2406*b*, 2406*c* are oriented in directions away from the center of the array formed by the four devices 2400.

Figure 25:
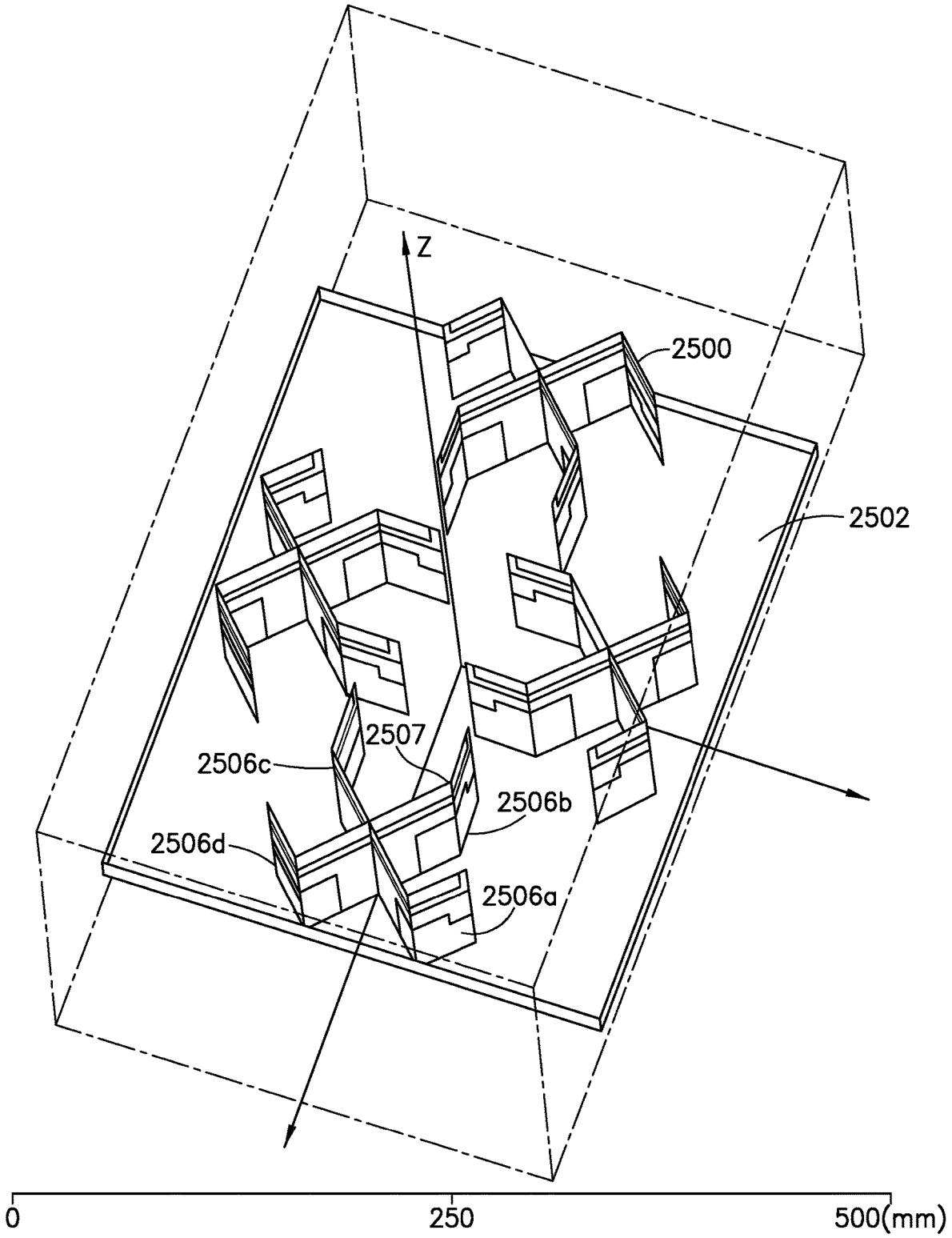

FIG. 25 shows four devices 2500 arrayed on a common ground plane 2502. Each of the four devices 2500 is based on device 1000 shown in FIGS. 10 to 14, although radiating arms 2506 do not form a "tripod." Instead, each of the radiating arms 2506*a*, 2506*d* has a portion, beginning at a point 2507, which is parallel to, or aligned with, a portion of the other. Each of radiating arms 2506*a*, 2506*d* has a portion, beginning at point 2509, which is oriented perpendicularly to the rest of its respective radiating arm 2506*a*, 2506*d*.

Devices 2500 are arranged on their common ground plane 2502 such that parallel portions of radiating arms 2506*b*, 2506*c* are oriented in directions toward the center of the array formed by the four devices 2500.

Figure 26:
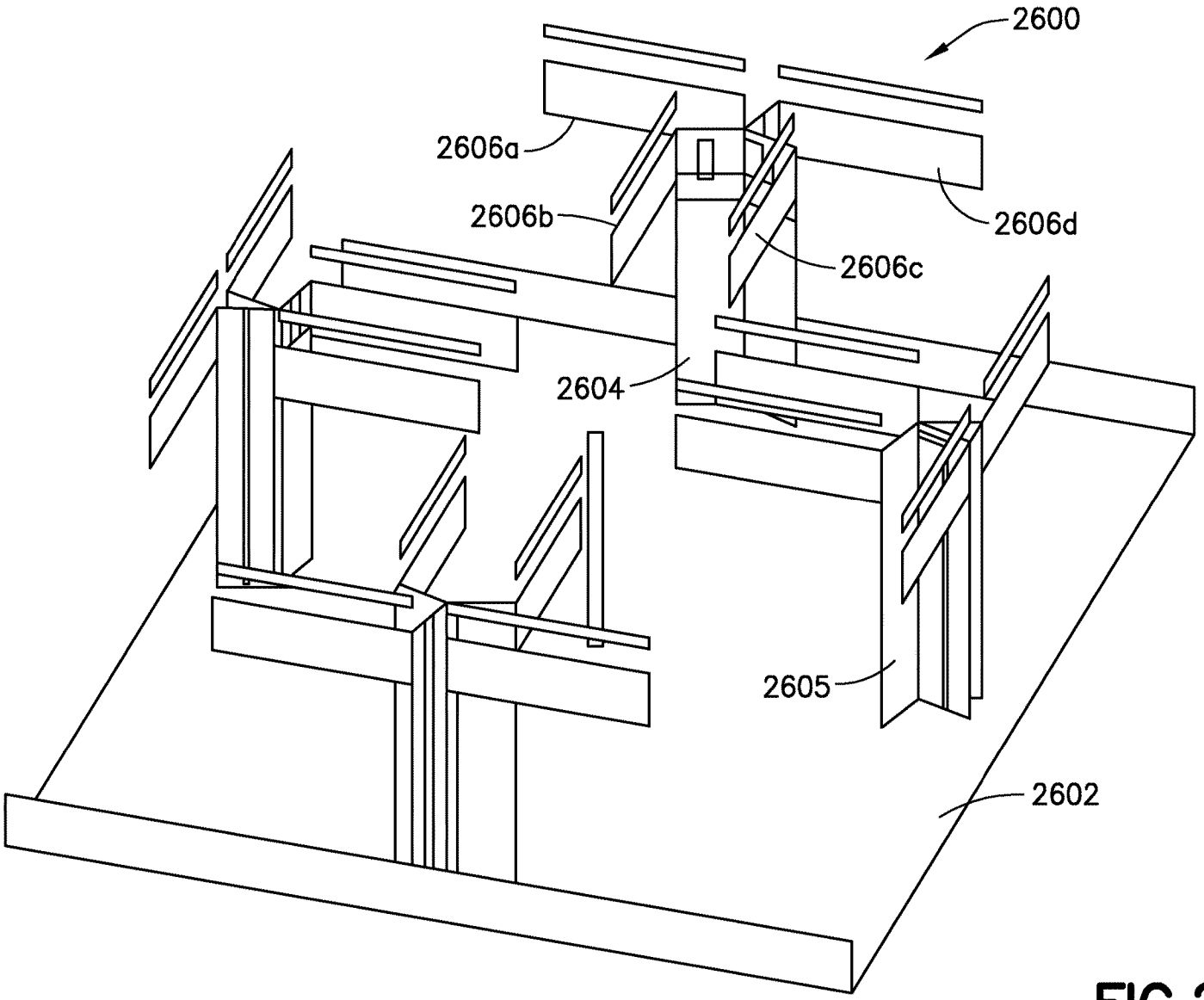

FIG. 26 shows four devices 2600 arrayed on a common ground plane 2602. Each of the four devices 2600 is based on device 1600 shown in FIGS. 16 to 19. Radiating arms 2606*a*, 2106*d* take orientations directly opposite to one another at central support 2604. As in FIGS. 16 to 19, radiating arms 2606*b*, 2606*c* are aligned parallel to one another from their respective parts of feeding probes 2605.

Devices 2600 are arranged on their common ground plane 2602 such that parallel radiating arms 2606*b*, 2606*c* are oriented in directions toward the center of the array formed by the four devices 2600.

In general, the various exemplary embodiments may be implemented in hardware or special purpose circuits, software, logic or any combination thereof. For example, some aspects may be implemented in hardware, while other aspects may be implemented in firmware or software, which may be executed by a controller, microprocessor or other computing device, although the exemplary embodiments are not limited thereto.

While various aspects of the exemplary embodiments of this disclosure may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

It should thus be appreciated that at least some aspects of the exemplary embodiments of the disclosure may be practiced in various components, such as integrated circuit chips and modules, and that the exemplary embodiments of this disclosure may be realized in an apparatus that is embodied as an integrated circuit. The integrated circuit, or circuits, may comprise circuitry, as well as possibly firmware, for embodying at least one or more of a data processor or data processors, a digital signal processor or processors, baseband circuitry and radio frequency circuitry that are configurable so as to operate in accordance with the exemplary embodiments of this disclosure.

Various modifications and adaptations to the foregoing exemplary embodiments of this disclosure may become apparent to those skilled in the relevant arts in view of the foregoing description, when read in conjunction with the accompanying drawings. For example, while the exemplary embodiments have been described above in the context of advancements to the 5G NR system, it should be appreciated that the exemplary embodiments of this disclosure are not limited for use with only this one particular type of wireless communication system. The exemplary embodiments of the disclosure presented herein are explanatory and not exhaustive or otherwise limiting of the scope of the exemplary embodiments.

The following abbreviations may have been used in the preceding discussion:

eNB eNodeB (4G Base Station)
GHz Gigahertz
gNB gNodeB (5G Base Station)
LB Low Band
LTE Long Term Evolution
NR New Radio (5G)
PCB Printed Circuit Board
RX Receive
TX Transmit
UE User Equipment 5G 5$^{th}$ Generation The terminology used herein is for the purpose of describing particular embodiments only and is not intended to be limiting of the disclosed embodiments. As used herein, the singular forms "a", "an", and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

The description of the present exemplary embodiments has been presented for purposes of illustration and description, but is not intended to be exhaustive or limited to the embodiments in the form disclosed. Many modifications and variations will be apparent to those of ordinary skill in the art without departing from the scope and spirit of the present disclosure. The embodiments were chosen and described in order to best explain the principles of the disclosure and the practical application, and to enable others of ordinary skill in the art to understand the disclosure for various embodiments with various modifications as are suited to the particular use contemplated.

Various modifications and adaptations may become apparent to those skilled in the relevant arts in view of the foregoing description, when read in conjunction with the accompanying drawings. However, any and all modifications of the teachings of this disclosure will still fall within the scope of the non-limiting embodiments thereof.

Although described in the context of particular embodiments, it will be apparent to those skilled in the art that a number of modifications and various changes to these teachings may occur. Thus, while the examples have been particularly shown and described with respect to one or more disclosed embodiments, it will be understood by those skilled in the art that certain modifications or changes may be made therein without departing from the scope of the disclosure as set forth above, or from the scope of the claims to follow.

What is claimed is:

1. An antenna comprising:

a ground plane in a horizontal plane;

a central support extending perpendicularly from said ground plane, said central support having two feeding probes, each of said feeding probes having a first part and a second part, each of said first part and said second part being in corresponding vertical planes and separated from one another and from the first and second parts of the other feeding probe; and four radiating arms, one radiating arm extending horizontally from each of the first and second parts of each feeding probe, wherein at least a portion of at least two of said radiating arms extends in horizontal directions different from horizontal orientations for the corresponding vertical planes of their respective parts of said feeding probes.

2. The antenna as claimed in claim 1, wherein said four radiating arms extend perpendicularly from their respective feeding probes and parallel to said ground plane.

3. The antenna as claimed in claim 1, wherein the first and second parts of one of said feeding probes are aligned with one another in a first direction, and the first and second parts of the other of said feeding probes are aligned with one another in a second direction different from said first direction.

4. The antenna as claimed in claim 3, wherein said first direction is perpendicular to said second direction.

5. The antenna as claimed in claim 1, wherein the first and second parts of one of the feeding probes are not aligned with respect to one another, and the first and second parts of the other feeding probe are not aligned with respect to one another.

6. The antenna as claimed in claim 1, wherein at least a portion of two of said radiating arms extends from their respective parts of said feeding probes parallel to one another, and at least a portion of the remaining two of said radiating arms extends from their respective parts of said feeding probes in opposite directions perpendicular to that of the two of said radiating arms extending parallel to one another.

7. The antenna as claimed in claim 1, wherein at least a portion of two of said radiating arms extends from their respective parts of said feeding probes in opposite directions.

8. The antenna as claimed in claim 1, wherein at least a portion of two of said radiating arms extends from their respective parts of said feeding probes parallel to one another, and at least a portion of the remaining two of said radiating arms extends from their respective parts of said feeding probes parallel to one another.

9. The antenna as claimed in claim 8, wherein the at least a portion of the remaining two of said radiating arms extends from their respective parts of said feeding probes in a direction opposite to that of the at least a portion of two of said radiating arms.

10. The antenna as claimed in claim 1, wherein at least a portion of two of said radiating arms extends from their respective parts of said feeding probes parallel to one another, and at least a portion of the remaining two of said radiating arms extends perpendicularly from their respective parts of said feeding probes.

11. An antenna array comprising:

a plurality of antennas disposed in an array on a common ground plane in a horizontal plane, wherein each of said antennas comprises:

a central support extending perpendicularly from said common ground plane, said central support having two feeding probes, each of said feeding probes having a first part and a second part, each of said first part and said second part being in corresponding vertical planes and separated from one another and from the first and second parts of the other feeding probe; and four radiating arms, one radiating arm extending horizontally from each of the first and second parts of each feeding probe, wherein at least a portion of at least two of said radiating arms extends in horizontal directions different from horizontal orientations for the corresponding vertical planes of their respective parts of said feeding probes.

12. The antenna array as claimed in claim 11, wherein, in at least one of said antennas, at least a portion of two of said radiating arms extends from their respective parts of said feeding probes in opposite directions.

13. The antenna array as claimed in claim 12, wherein said plurality of antennas is disposed on said common ground plane around a common center, and wherein said at least a portion of two of said radiating arms extending from their respective parts of said feeding probes in opposite directions is disposed outermost from said common center.

14. The antenna array as claimed in claim 11, wherein, in at least one of said antennas, at least a portion of two of said radiating arms extends from their respective parts of said feeding probes parallel to one another, and at least a portion of the remaining two of said radiating arms extends from their respective parts of said feeding probes in opposite directions perpendicular to that of the two of said radiating arms extending parallel to one another.

15. The antenna array as claimed in claim 14, wherein said plurality of antennas is disposed on said common ground plane around a common center, and wherein said at least a portion of two of said radiating arms extending from their respective parts of said feeding probes parallel to one another is disposed innermost toward said common center.

16. The antenna array as claimed in claim 11, wherein, in at least one of said antennas, at least a portion of two of said radiating arms extends from their respective parts of said feeding probes parallel to one another, and at least a portion of the remaining two of said radiating arms extends from their respective parts of said feeding probes parallel to one another, and wherein the at least a portion of the remaining two of said radiating arms extends from their respective parts of said feeding probes in a direction opposite to that of the at least a portion of two of said radiating arms.

17. The antenna array as claimed in claim 16, wherein said plurality of antennas is disposed on said common ground plane around a common center, and wherein said at least a portion of two of said radiating arms extending from their respective parts of said feeding probes parallel to one another, and said at least a portion of the remaining two of said radiating arms extending from their respective parts of said feeding probes parallel to one another, are oriented in a direction perpendicular to a line from said central support to said common center.

18. The antenna array as claimed in claim 11, wherein, in at least one of said antennas, at least a portion of two of said radiating arms extends from their respective parts of said feeding probes parallel to one another, and at least a portion of the remaining two of said radiating arms extends perpendicularly from their respective parts of said feeding probes.

19. The antenna array as claimed in claim 18, wherein said plurality of antennas is disposed on said common ground plane around a common center, and wherein said at least a portion of two of said radiating arms extending from their respective parts of said feeding probes parallel to one another is disposed outermost from said common center.

20. The antenna array as claimed in claim 18, wherein said plurality of antennas is disposed on said common ground plane around a common center, and wherein said at least a portion of two of said radiating arms extending from their respective parts of said feeding probes parallel to one another is disposed innermost toward said common center.

21. The antenna array as claimed in claim 11, wherein, in at least one of said antennas, the first and second parts of one of the feeding probes are not aligned with respect to one another, and the first and second parts of the other feeding probe are not aligned with respect to one another, and wherein at least a portion of two of said radiating arms extends from their respective parts of said feeding probes parallel to one another, and at least a portion of the remaining two of said radiating arms extends from their respective parts of said feeding probes in opposite directions perpendicular to that of the two of said radiating elements extending parallel to one another.

22. The antenna array as claimed in claim 21, wherein said plurality of antennas is disposed on said common ground plane around a common center, and wherein said at least a portion of two of said radiating arms extending from their respective parts of said feeding probes parallel to one another is disposed innermost toward said common center.

* * * * *